US012262809B2

(12) United States Patent
Choi

(10) Patent No.: US 12,262,809 B2
(45) Date of Patent: Apr. 1, 2025

(54) AUTOMATICALLY LOCKABLE PIVOTING MECHANISM AND SLIDING MECHANISM, AND FRAME AND TABLE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 18/639,593

(22) Filed: Apr. 18, 2024

(65) Prior Publication Data

US 2024/0260742 A1 Aug. 8, 2024

Related U.S. Application Data

(62) Division of application No. 17/368,284, filed on Jul. 6, 2021, now Pat. No. 11,986,088.

(30) Foreign Application Priority Data

May 7, 2021 (CN) ..... 202120962684.9
May 7, 2021 (CN) ..... 202120962737.7

(51) Int. Cl.
*A47B 3/087* (2006.01)
*A47B 3/08* (2006.01)
*A47B 3/091* (2006.01)

(52) U.S. Cl.
CPC ..... *A47B 3/087* (2013.01); *A47B 3/0815* (2013.01); *A47B 3/0912* (2013.01); *A47B 3/0913* (2013.01); *A47B 2200/0036* (2013.01); *A47B 2200/005* (2013.01)

(58) Field of Classification Search
CPC ..... A47B 3/087; A47B 3/0815; A47B 3/0912; A47B 3/0913; A47B 2200/005; A47B 2200/0036; Y10T 403/32467; Y10T 403/32483; Y10T 403/32508; Y10T 403/32516
See application file for complete search history.

(56) References Cited

U.S. PATENT DOCUMENTS 1,063,642 A 6/1913 Birdsell
2,136,569 A 11/1938 Trimpi
2,803,033 A 8/1957 Rachman
2,803,050 A 8/1957 Birger
(Continued)

FOREIGN PATENT DOCUMENTS

CA 2971886 A1 12/2018
DE 29515948 U1 1/1996
(Continued)

*Primary Examiner* — Daniel J Wiley
(74) *Attorney, Agent, or Firm* — MORGAN, LEWIS & BOCKIUS LLP

(57) ABSTRACT

Disclosed are pivoting mechanisms, sliding mechanisms, frames and tables. A pivoting mechanism includes a first coupling piece, a second coupling piece and a rod. The first and second coupling pieces are pivotally coupled with each other. The rod is operated by gravity to automatically lock or unlock the first and second coupling pieces. A sliding mechanism generally includes a slider and a locking member. The slider includes a sleeve to be slidably coupled with a bar. The locking member includes a restriction piece, operated by an elastic piece to be disposed inside of the bar, to automatically lock the sleeve at a certain position of the bar.

20 Claims, 21 Drawing Sheets

(56) References Cited

U.S. PATENT DOCUMENTS

| | | | | |
|---|---|---|---|---|
| 2,868,599 | A | 1/1959 | Roggio | |
| 3,075,809 | A | 1/1963 | Wilson | |
| 3,187,373 | A | 6/1965 | Fisher | |
| 3,368,504 | A | 2/1968 | Cohen | |
| 3,410,232 | A | 11/1968 | Bills | |
| 3,410,327 | A | 11/1968 | Ausnit | |
| 3,861,328 | A | 1/1975 | Lawless | |
| 4,111,482 | A | 9/1978 | Jones | |
| 4,191,111 | A | 3/1980 | Emmert | |
| 4,285,105 | A | 8/1981 | Kirkpatrick | |
| 4,561,108 | A | 12/1985 | Kamp | |
| 4,792,240 | A | 12/1988 | Ausnit | |
| 5,325,794 | A | 7/1994 | Hontani | |
| 5,392,718 | A | 2/1995 | Stevens | |
| 5,483,710 | A | 1/1996 | Chan | |
| 5,676,062 | A | 10/1997 | Lloyd | |
| 5,745,954 | A | 5/1998 | Shogan | |
| 5,857,229 | A | 1/1999 | Magnani, Jr. | |
| 5,921,623 | A | 7/1999 | Nye | |
| 6,192,809 | B1 | 2/2001 | Riach | |
| 6,223,366 | B1 | 5/2001 | Cheng | |
| 6,347,831 | B1 | 2/2002 | Nye | |
| 6,363,550 | B1 | 4/2002 | Wang | |
| 6,508,262 | B1 * | 1/2003 | Takayama | E04H 15/50 135/912 |
| 6,530,331 | B2 | 3/2003 | Stanford | |
| 6,644,734 | B1 | 11/2003 | Tseng | |
| 6,843,183 | B2 | 1/2005 | Strong | |
| 6,971,321 | B1 | 12/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,260,871 | B2 | 8/2007 | Borchardt | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,113,130 | B2 | 2/2012 | Leng | |
| 8,156,875 | B2 | 4/2012 | Neunzert et al. | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 8,904,943 | B2 | 12/2014 | Jin | |
| 9,027,952 | B2 | 5/2015 | Zhu | |
| 9,103,368 | B2 | 8/2015 | Mendes | |
| D748,418 | S | 2/2016 | Johnson et al. | |
| 9,277,808 | B2 | 3/2016 | Cai et al. | |
| 9,282,812 | B2 | 3/2016 | Chang | |
| D756,694 | S | 5/2016 | Johnson et al. | |
| 9,351,563 | B2 | 5/2016 | Bennett et al. | |
| 9,462,880 | B1 | 10/2016 | Lin | |
| 10,159,334 | B1 | 12/2018 | Wang | |
| 10,470,561 | B2 | 11/2019 | Clegg et al. | |
| 10,806,246 | B1 | 10/2020 | Chen | |
| 10,806,247 | B1 * | 10/2020 | Chen | A47B 3/0913 |
| 11,234,525 | B1 | 2/2022 | Tsai | |
| 2003/0089286 | A1 | 5/2003 | Wang | |
| 2004/0070235 | A1 | 4/2004 | Gregory | |
| 2004/0195869 | A1 | 10/2004 | Zhurong | |
| 2005/0005826 | A1 | 1/2005 | Strong | |
| 2005/0097829 | A1 | 5/2005 | Seo | |
| 2005/0103239 | A1 | 5/2005 | Neunzert | |
| 2005/0241550 | A1 | 11/2005 | Neunzert | |
| 2005/0279260 | A1 | 12/2005 | Stanford | |
| 2006/0062632 | A1 | 3/2006 | Jang | |
| 2006/0181114 | A1 | 8/2006 | Nye | |
| 2006/0196395 | A1 | 9/2006 | Lin | |
| 2007/0079441 | A1 | 4/2007 | Chen | |
| 2008/0078310 | A1 | 4/2008 | VanNimwegen | |
| 2009/0293779 | A1 | 12/2009 | Leng | |
| 2013/0000528 | A1 * | 1/2013 | Jin | A47B 3/0915 108/127 |
| 2013/0025509 | A1 | 1/2013 | Jin | |
| 2013/0233210 | A1 | 9/2013 | Jin | |
| 2014/0030012 | A1 | 1/2014 | Lee | |
| 2014/0070070 | A1 | 3/2014 | Shi | |
| 2014/0099155 | A1 | 4/2014 | Chen | |
| 2014/0130837 | A1 | 5/2014 | Sy-Facunda | |
| 2016/0348395 | A1 | 12/2016 | Jin | |
| 2017/0013955 | A1 | 1/2017 | Lin | |
| 2017/0325592 | A1 | 11/2017 | Suh | |
| 2017/0340100 | A1 | 11/2017 | Tsai | |
| 2018/0153302 | A1 | 6/2018 | Jiang | |
| 2018/0171648 | A1 | 6/2018 | Woodward | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0029684 | A1 | 1/2020 | Jiang | |
| 2020/0390233 | A1 | 12/2020 | Leng | |
| 2021/0112968 | A1 | 4/2021 | Ponomar | |
| 2021/0177135 | A1 | 6/2021 | Leng | |
| 2021/0274929 | A1 | 9/2021 | Choi | |
| 2021/0274930 | A1 | 9/2021 | Choi | |
| 2022/0022643 | A1 | 1/2022 | Choi | |

FOREIGN PATENT DOCUMENTS

| | | | |
|---|---|---|---|
| EP | 1492432 | B1 | 10/2016 |
| WO | WO 2013000149 | A1 | 1/2013 |

* cited by examiner

AUTOMATICALLY LOCKABLE PIVOTING MECHANISM AND SLIDING MECHANISM, AND FRAME AND TABLE HAVING SAME

CROSS-REFERENCE TO RELATED APPLICATIONS

The present application is a divisional of U.S. patent application Ser. No. 17/368,284 filed Jul. 6, 2021, which claims priority to Chinese Utility Model Applications CN 202120962684.9 filed May 7, 2021 and CN 202120962737.7 filed May 7, 2021. The disclosure of each application is incorporated herein for all purposes by reference in its entirety.

FIELD OF THE INVENTION

The present invention generally relates to pivoting mechanisms, sliding mechanisms, frames and tables. In particular, the present invention relates to automatically lockable pivoting mechanisms, automatically lockable sliding mechanisms, and frames and tables having automatically lockable pivoting and/or sliding mechanisms.

BACKGROUND

Foldable tables are popular because they require less storage space and are easy to carry around. An existing foldable table generally includes two panels coupled to a supporting frame having two or more foldable legs. However, many exiting foldable tables lack a mechanism to control the folding and unfolding of the tables. In particular, some exiting foldable tables lack a mechanism to lock the legs when the tables are in use. Consequently, existing foldable tables may fold accidentally, and are not safe to use.

Given the current state of the art, there remains a need for pivoting mechanisms, sliding mechanisms, frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides automatically lockable pivoting mechanisms and sliding mechanisms that can be used to prevent accidental unfolding of tables, legs or leg assemblies. The present disclosure further provides frames and tables having automatically lockable pivoting mechanisms, automatically lockable sliding mechanisms, or both.

In various exemplary embodiments, the present disclosure provides a pivoting mechanism including a first coupling piece, a second coupling piece, a third coupling piece, a first rod and a second rod. The first coupling piece is configured to be fixed at a proximal end of a first bar. The first coupling piece includes a first slot elongated in a first direction. The second coupling piece is configured to be fixed at a proximal end of a second bar. The second coupling piece includes a second slot having a closed bottom and an open top. The second slot has a length in the first direction that is shorter than the first slot of the first coupling piece in the first direction. The third coupling piece includes a third slot having a closed bottom and a closed top. The third slot is elongated in the first direction. The first rod is disposed, cross-sectional-wise, in the third slot of the third coupling piece and movable along the third slot of the third coupling piece. The first and second coupling pieces are pivotally coupled with each other by the first rod. The second rod is integrally formed or coupled with a top portion of the third coupling piece. In addition, the second rod is disposed, cross-sectional-wise, in the first slot of the first coupling piece and movable along the first slot of the first coupling piece. When the first and second coupling pieces are aligned with each other and the open top of the second slot of the second coupling piece faces downwardly, the third coupling piece together with the second rod moves by gravity to a first position. At the first position, the second rod is disposed outside of the second slot of the second coupling piece, thereby allowing the first and second coupling pieces to rotate with respect to each other around the first rod. When the first and second coupling pieces are aligned with each other and the open top of the second slot of the second coupling piece faces upwardly, the third coupling piece together with the second rod moves by gravity to a second position. At the second position, the second rod is disposed in the second slot of the second coupling piece, thereby restricting the first and second coupling pieces from rotating with respect to each other around the first rod.

In an exemplary embodiment, the first rod is disposed adjacent to the bottom of the third slot of the third coupling piece at the first position, and adjacent to the top of the third slot of the third coupling piece at the second position.

In some exemplary embodiments, each of the first and second coupling pieces includes a horizontal piece, a first lug at a first side of the horizontal piece and a second lug at a second side of the horizontal piece. The first and second lugs are substantially parallel to each other, and each of the first and second lugs is formed with a corresponding first or second slot.

In an exemplary embodiment, at least a portion of the third coupling piece is disposed between the first and second lugs of the first coupling piece, and at least a portion of the first and second lugs of the first coupling piece is disposed between the first and second lugs of the second coupling piece.

In some exemplary embodiments, the first and second coupling pieces are pivotally coupled with each other by the first rod through a first hole formed at the first coupling piece and a second hole formed at the second coupling piece. The second rod is coupled with the third coupling piece by passing through a third hole formed at the third coupling piece.

In some exemplary embodiments, when the first and second coupling pieces are aligned with each other, the first slot of the first coupling piece and the third slot of the third coupling piece are aligned with each other in the first direction.

In various exemplary embodiments, the present disclosure provides a sliding mechanism including a slider and a locking member. The slider includes a sleeve configured to be slidably coupled with a first bar and pivotally coupled with one or more second bars. At least a portion of the first bar is hollow and a first restriction hole is formed at a side wall of the hollow portion of the first bar. Corresponding to the first restriction hole formed at the first bar, a second restriction hole is formed at the sleeve. A push button is coupled with the sleeve and insertable into the second restriction hole. The locking member includes an elastic piece and a restriction piece formed or coupled with the elastic piece. The elastic piece is configured to be disposed in the hollow portion of the first bar and adjacent to the first restriction hole formed at the first bar. When the second restriction hole formed at the sleeve is aligned with the first restriction hole formed at the first bar, the elastic piece pushes the restriction piece into the first restriction hole formed at the first bar and the second restriction hole formed at the sleeve, thereby restricting the sleeve from moving along the first bar. The push button is configured to push the restriction piece inwardly to disengage the restriction piece from the second restriction hole formed at the sleeve, thereby allowing the sleeve to move along the first bar.

In some exemplary embodiments, the sleeve includes one or more pivoting portions, each for pivotally coupling an end of a second bar in the one or more second bars.

In some exemplary embodiments, the elastic piece of the locking member is a bended piece, and the restriction piece is coupled or formed with the elastic piece at a location adjacent to an end of the elastic piece.

In an exemplary embodiment, the elastic piece of the locking member includes a first portion, a second portion bended with respect to the first portion, and a third portion bended with respect to the second portion.

In various exemplary embodiments, the present disclosure provides a frame including a first longitudinal bar and a second longitudinal bar. The first longitudinal bar is disposed at a first side of the frame. The second longitudinal bar is disposed at a second side of the frame and substantially parallel to the first longitudinal bar. Each of the first and second longitudinal bars includes a first bar and a second bar pivotally coupled with each other at their proximal ends by a pivoting mechanism disclosed herein.

In some exemplary embodiments, the frame includes a first lateral bar, a second lateral bar, a plurality of legs, a plurality of sliding mechanisms, and a plurality of oblique bars. The first lateral bar is disposed at a third side of the frame and has a first end pivotally coupled with the first longitudinal bar and a second end pivotally coupled with the second longitudinal bar. The second lateral bar is disposed at a fourth side of the frame and has a first end pivotally coupled with the first longitudinal bar and a second end pivotally coupled with the second longitudinal bar. Each leg in the plurality of legs has an end fixedly coupled with the first or second lateral bar. Each sliding mechanism in the plurality of sliding mechanisms has a sleeve slidably coupled with the first or second longitudinal bar and selectively movable along a length direction of the first or second longitudinal bar. Each oblique bar in the plurality of oblique bars has a first end and a second end, with the first end pivotally coupled with a corresponding leg in the plurality of legs and the second end pivotally coupled with the sleeve of a corresponding sliding mechanism in the plurality of assemblies.

In an exemplary embodiment, for each of the first and second longitudinal bars, the frame further includes a first coupler and a second coupler. The first coupler is disposed adjacent to a distal end of the first bar, and the second coupler is disposed adjacent to a distal end of the second bar. When the first and second bars are folded onto each other, the first and second couplers are engaged with each other, thereby preventing the first and second bars from accidental unfolding.

In various exemplary embodiments, the present disclosure provides a frame including a first longitudinal bar, a second longitudinal bar, a first lateral bar, a second lateral bar, a plurality of legs, a plurality of oblique bars, and a plurality of sliding mechanisms disclosed herein. The first longitudinal bar is disposed at a first side of the frame, and the second longitudinal bar is disposed at a second side of the frame and substantially parallel to the first longitudinal bar. The first lateral bar is disposed at a third side of the frame and has a first end pivotally coupled with the first longitudinal bar and a second end pivotally coupled with the second longitudinal bar. The second lateral bar is disposed at a fourth side of the frame and has a first end pivotally coupled with the first longitudinal bar and a second end pivotally coupled with the second longitudinal bar. Each leg in the plurality of legs has an end fixedly coupled with the first or second lateral bar. The sleeve of each sliding mechanism in the plurality of sliding mechanisms is slidably coupled with the first or second longitudinal bar. The elastic piece of each sliding mechanism in the plurality of sliding mechanisms is disposed in the first or second longitudinal bar and adjacent to a first restriction hole formed at the first or second longitudinal bar. Each oblique bar in the plurality of oblique bars has a first end and a second end, with the first end pivotally coupled with a corresponding leg in the plurality of legs, and the second end pivotally coupled with the sleeve of a corresponding sliding mechanism in the plurality of sliding mechanisms.

In some exemplary embodiments, the frame includes a plurality of positioning pieces. Each positioning piece in the plurality of positioning pieces is fixedly coupled with the first or second longitudinal bar at a position to help align the second restriction hole formed at the sleeve of a corresponding sliding mechanism in the plurality of sliding mechanisms with a first restriction hole formed at the first or second longitudinal bar.

In an exemplary embodiment, each respective positioning piece is formed with a sloped protrusion to engage with a sloped surface formed at the sleeve of the corresponding sliding mechanism.

In various exemplary embodiments, the present disclosure provides a frame including a mounting assembly, a first leg assembly, a second leg assembly, a first supporting assembly, and a second supporting assembly. The first leg assembly has an upper end coupled with the mounting assembly at one side of the frame, and the second leg assembly has an upper end coupled with the mounting assembly at another side of the frame. The first supporting assembly is pivotally coupled with the mounting assembly and first table leg assembly to control rotation of the first leg assembly. The second supporting assembly is pivotally coupled with the mounting assembly and second table leg assembly to control rotation of the second leg assembly. Each of the first and second supporting assemblies includes a first supporting bar, one or more second supporting bars, and a sliding mechanism disclosed herein. At least a portion of the first supporting bar is hollow and a first restriction hole is formed at a side wall of the hollow portion of the first supporting bar. The sleeve of the sliding mechanism is slidably coupled with the first supporting bar and movable along a length direction of the first supporting bar. The elastic piece of the sliding mechanism is disposed in the first supporting bar and adjacent to the first restriction hole formed at the first supporting bar. Each of the one or more second supporting bars has a first end pivotally coupled with the sleeve of the sliding mechanism.

In some exemplary embodiments, the mounting assembly includes a first longitudinal bar disposed at a first side of the frame, and a second longitudinal bar disposed at a second side of the frame and substantially parallel to the first longitudinal bar. The mounting assembly also includes first, second and third lateral bars, each having a first end coupled with the first longitudinal bar and a second end coupled with the second longitudinal bar. The first lateral bar is disposed at a third side of the frame, the second lateral bar is disposed at a fourth side of the frame, and the third lateral bar is disposed between the first and second lateral bar. In such embodiments, the first leg assembly has an upper end coupled with the first lateral bar and is rotatable with respect to the first and second longitudinal bars. The second leg assembly has an upper end coupled with the second lateral bar and rotatable with respect to the first and second longitudinal bars. The first supporting assembly is pivotally coupled with the third lateral bar and first table leg assembly to control rotation of the first leg assembly with respect to the first and second longitudinal bars. The second supporting assembly is pivotally coupled with the third lateral bar and second table leg assembly to control rotation of the second leg assembly with respect to the first and second longitudinal bars.

In some exemplary embodiments, the first restriction hole is formed adjacent to a first end of the first supporting bar. A second end of the first supporting bar is pivotally coupled with the first or second leg assembly, and a second end of each second supporting bar in the one or more second supporting bars is pivotally coupled with the third lateral bar.

In an exemplary embodiment, each of the first and second supporting assemblies further includes a positioning piece formed or coupled with the first supporting bar adjacent to the first end of the first supporting bar. The positioning piece helps align the second restriction hole formed at the sleeve of the sliding mechanism with the first restriction hole formed at the first supporting bar or to prevent complete disengagement of the slider of the sliding mechanism from the first supporting bar.

In some exemplary embodiments, each of the first and second longitudinal bars includes a first bar and a second bar pivotally coupled with each other.

The pivoting mechanisms, sliding mechanisms, frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
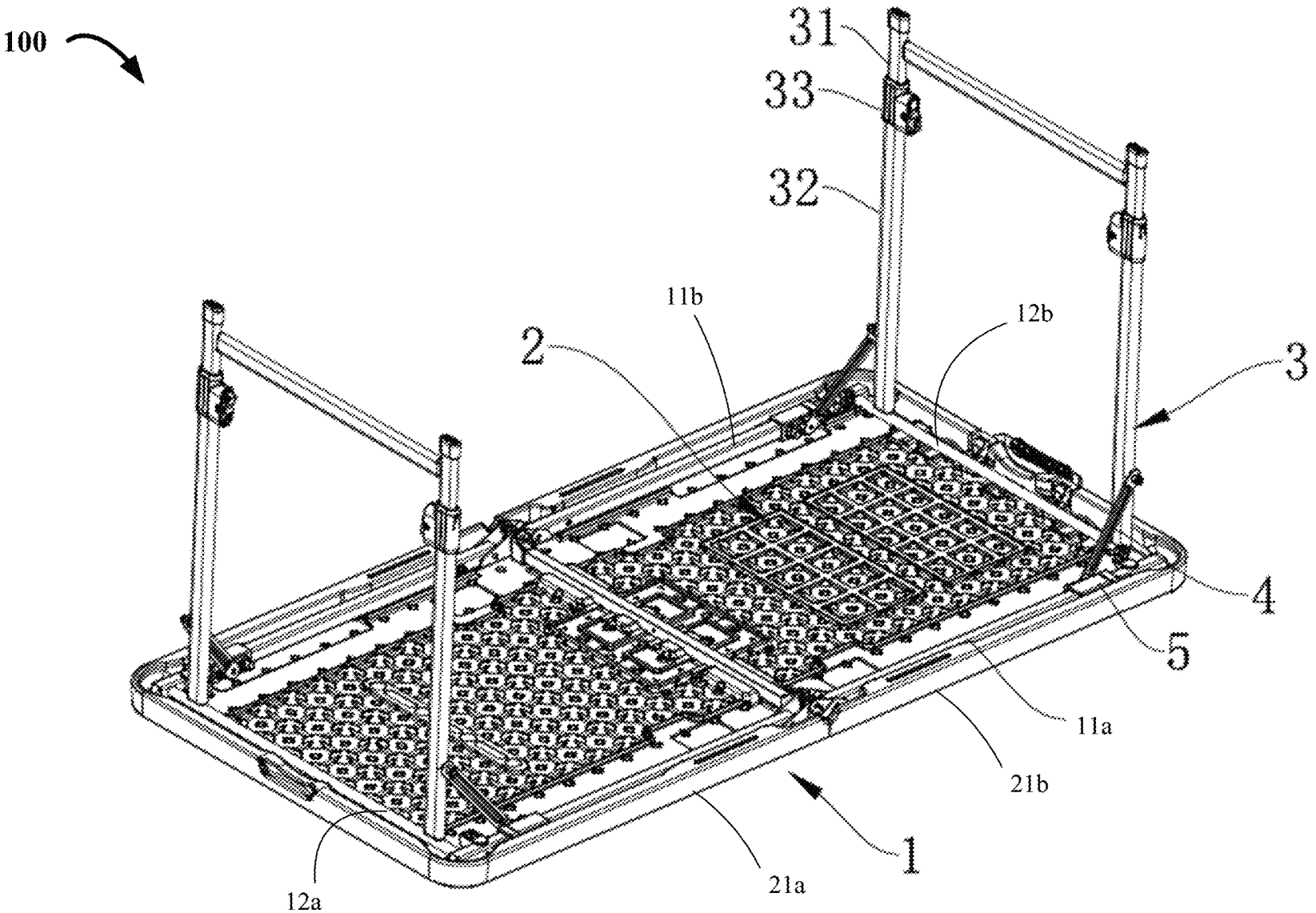
FIG. 1A is a bottom perspective view illustrating an exemplary table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application—and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of pivoting mechanisms, sliding mechanisms, frames having pivoting mechanisms, frames having sliding mechanisms, frames having both pivoting mechanisms and sliding mechanisms, and tables having one or more such frames. A pivoting mechanism generally includes a first coupling piece, a second coupling piece and a rod. The first and second coupling pieces are pivotally coupled with each other. The rod is operated by gravity to automatically lock or unlock the first and second coupling pieces. A sliding mechanism generally includes a slider having a sleeve configured to be slidably coupled with a bar. The sliding mechanism also includes a locking member configured to automatically lock the slider at a certain position of the bar.

The frames and tables of the present disclosure can be of various sizes. For instance, a frame of the present disclosure can be configured for a coffee table, a dining table, or the like, and can be of a square or rectangular shape. They can be made of various materials including but not limited to metals (e.g., iron, steel, and aluminum), plastics and woods.

Figure 1B:
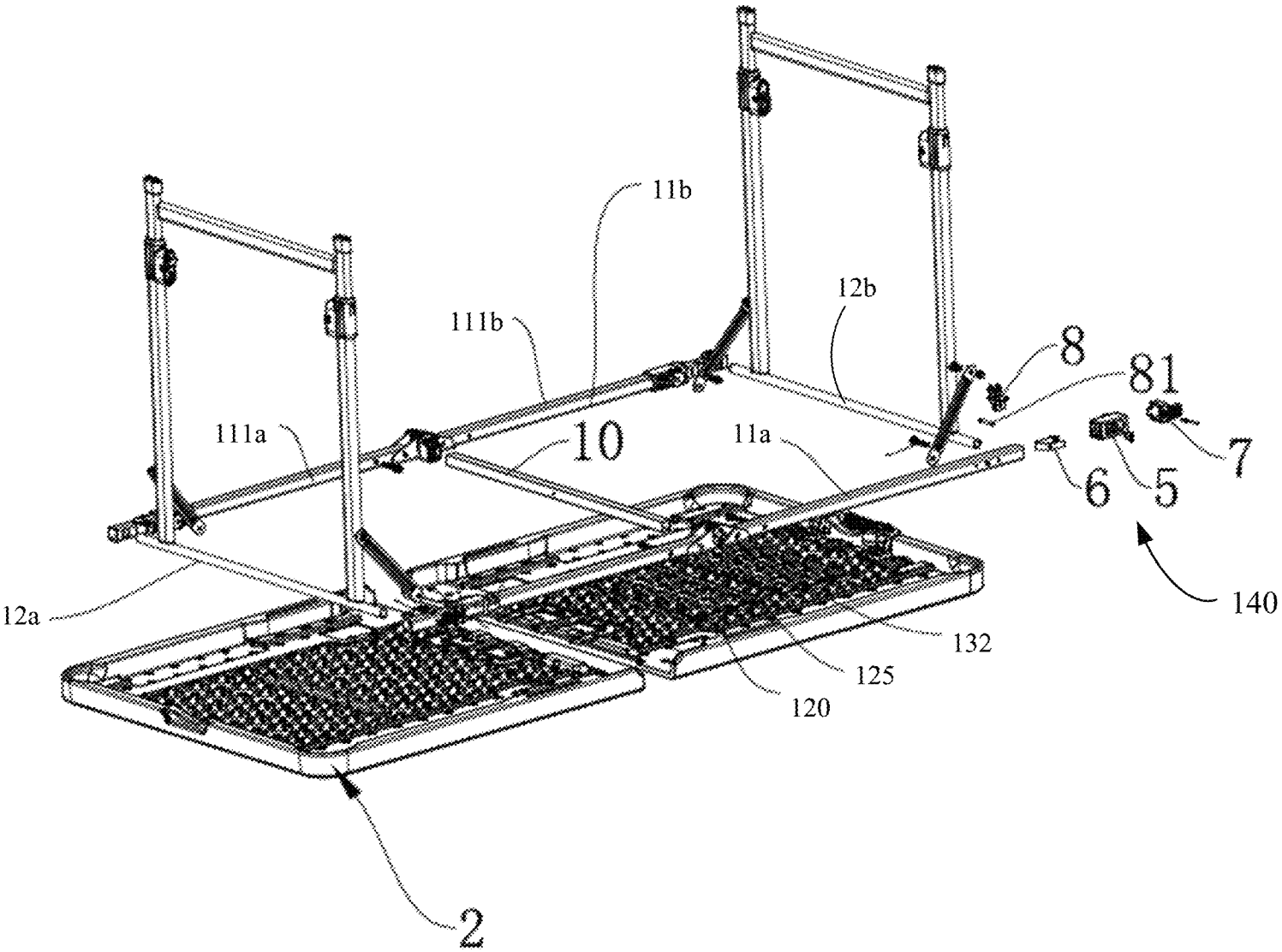
FIG. 1B is a partially disassembled view illustrating the exemplary table of FIG. 1A.

Referring now to FIGS. 1A and 1B, there is depicted an exemplary table in accordance with some embodiments of the present disclosure. As shown, exemplary table 100 includes a tabletop, such as tabletop 2, and a frame, such as frame 1, coupled with the tabletop and supporting the tabletop when in use. In some exemplary embodiments, tabletop 2 includes first table panel 21*a* and second table panel 21*b*, which can be but do not necessarily have to be identical or symmetric with respect to each other. In some exemplary embodiments, the tabletop or each of the first and second panels is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel generally includes a first panel wall, a second panel wall and a generally hollow interior formed between the first and second panel walls. The panel can be of various regular or irregular shapes, including but not limited to a square shape, a half circular shape or a rectangular shape. The panel can have other features, such as depressions, ridges, or the like, monolithically formed with the first and/or second panel walls.

Frame 1 includes a first longitudinal bar, such as first longitudinal bar 11*a*, and a second longitudinal bar, such as second longitudinal bar 11*b*. The first longitudinal bar is disposed at a first side of the frame. The second longitudinal bar is disposed at a second side of the frame and substantially parallel to the first longitudinal bar. It should be noted that the term "side" does not necessarily mean an outmost edge of a frame or an outmost edge of a table. It should also be noted that the first and second longitudinal bars can be but do not necessarily have to be identical or symmetric with respect to each other. By way of example, FIGS. 1A and 1B illustrate that the first and second longitudinal bars are substantially the same.

In some exemplary embodiments, each of the first and second longitudinal bars includes a first bar, such as first bar 111*a*, and a second bar, such as second bar 111*b*. The first and second bars can be configured the same or differently, e.g., having the same or different lengths, shapes, sizes, or made of the different materials. By way of example, FIGS. 1A and 1B illustrate that the first and second bars are substantially the same.

The first and second bars are pivotally coupled with each other at their proximal ends. In some exemplary embodiments, the first and second bars are pivotally coupled with each other by a pivoting mechanism, such as pivoting mechanism 120 illustrated in FIGS. 2A-2C. Generally, a pivoting mechanism of the present disclosure includes first and second coupling pieces configured to be fixed respectively at proximal ends of first and second bars. The pivoting mechanism also includes a rod to control the relative movement of the first and second coupling pieces. In some exemplary embodiments, the pivoting mechanism includes a third coupling piece, and two rods to control the relative movement of the first and second coupling pieces.

For instance, in some exemplary embodiments, pivoting mechanism 120 includes first coupling piece 121, second coupling piece 122, third coupling piece 123, first rod 131 and second rod 132. First coupling piece 121 is configured to be fixedly coupled with the first bar 111*a* at an end of the first bar, for instance, by welding, bolting or the like. Second coupling piece 122 is configured to be fixedly coupled with second bar 111*b* at an end of the second bar, for instance, by welding, bolting or the like.

Figure 3A:
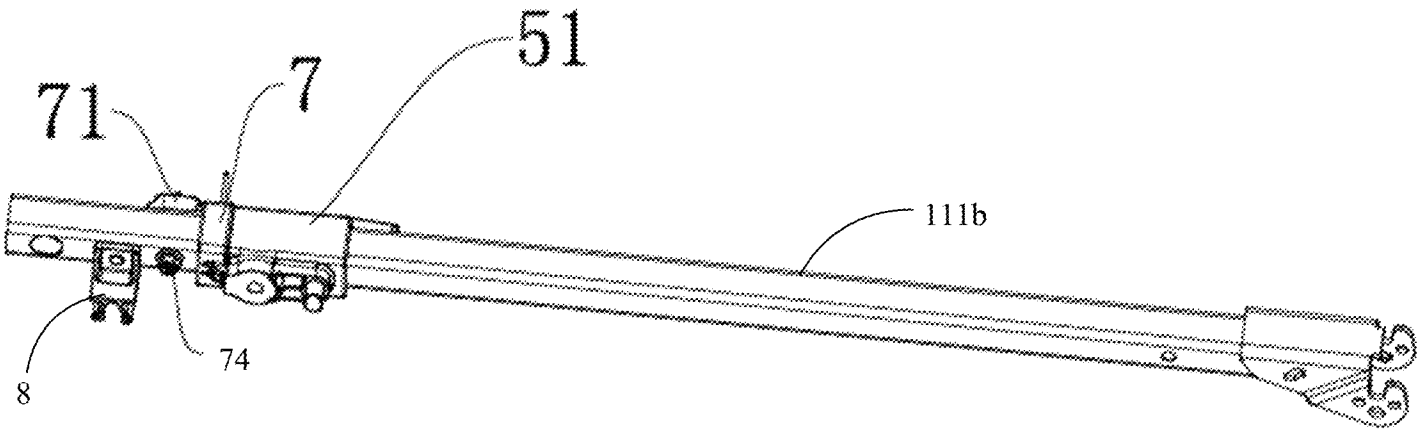
FIG. 3A is a perspective view illustrating an exemplary sliding mechanism in a locked state and other components of the exemplary table of FIG. 1A.

In some exemplary embodiments, first coupling piece 121 is formed with a hole such as hole 124 and a slot such as slot 125 above hole 124 (not necessarily directly above; it can have an offset in the vertical or horizontal direction or in both directions). Slot 125 is elongated in a first direction, e.g., the vertical direction in FIGS. 3A-3C. Second coupling piece 122 is formed with a hole such as hole 126 and a slot such as slot 127 above hole 126 (not necessarily directly above; it can have an offset in the vertical or horizontal direction or in both directions). Slot 127 has a closed bottom and an open top. Slot 127 of the second coupling piece is shorter than slot 125 of the first coupling piece, e.g., the slot of the second coupling piece has a length in the first direction that is shorter than the slot of the first coupling piece in the first direction. Third coupling piece 123 is formed with a slot such as slot 129. Slot 129 has a closed bottom and a closed top. Similar to the slot of the first coupling piece, the slot of the third coupling piece is elongated in the first direction.

The first, second and third coupling pieces are coupled with each other by first rod 131, for instance, by having the first rod pass through the hole formed at the first coupling piece, the hole formed at the second coupling piece, and the slot of the third coupling piece (e.g., the first rod is disposed, cross-sectional-wise, in the slot of the third coupling piece). Such a connection allows the first and second coupling pieces to rotate with respect to each other around the first rod. Such a connection also allows relative movement between the first rod and the third coupling piece, e.g., allowing the first rod to move along the elongated slot of the third coupling piece.

Second rod 132 is integrally formed or coupled with a top portion of third coupling piece 123, and movable together with the third coupling piece. For instance, in an exemplary embodiment, third coupling piece 123 is formed with a hole such as hole 128, and rod 132 is coupled with the third coupling piece by passing through the hole of the third coupling piece. In addition, the second rod is disposed, cross-sectional-wise, in the elongated slot of the first coupling piece, and thus is movable along the elongated slot of the first coupling piece.

Figure 2A:
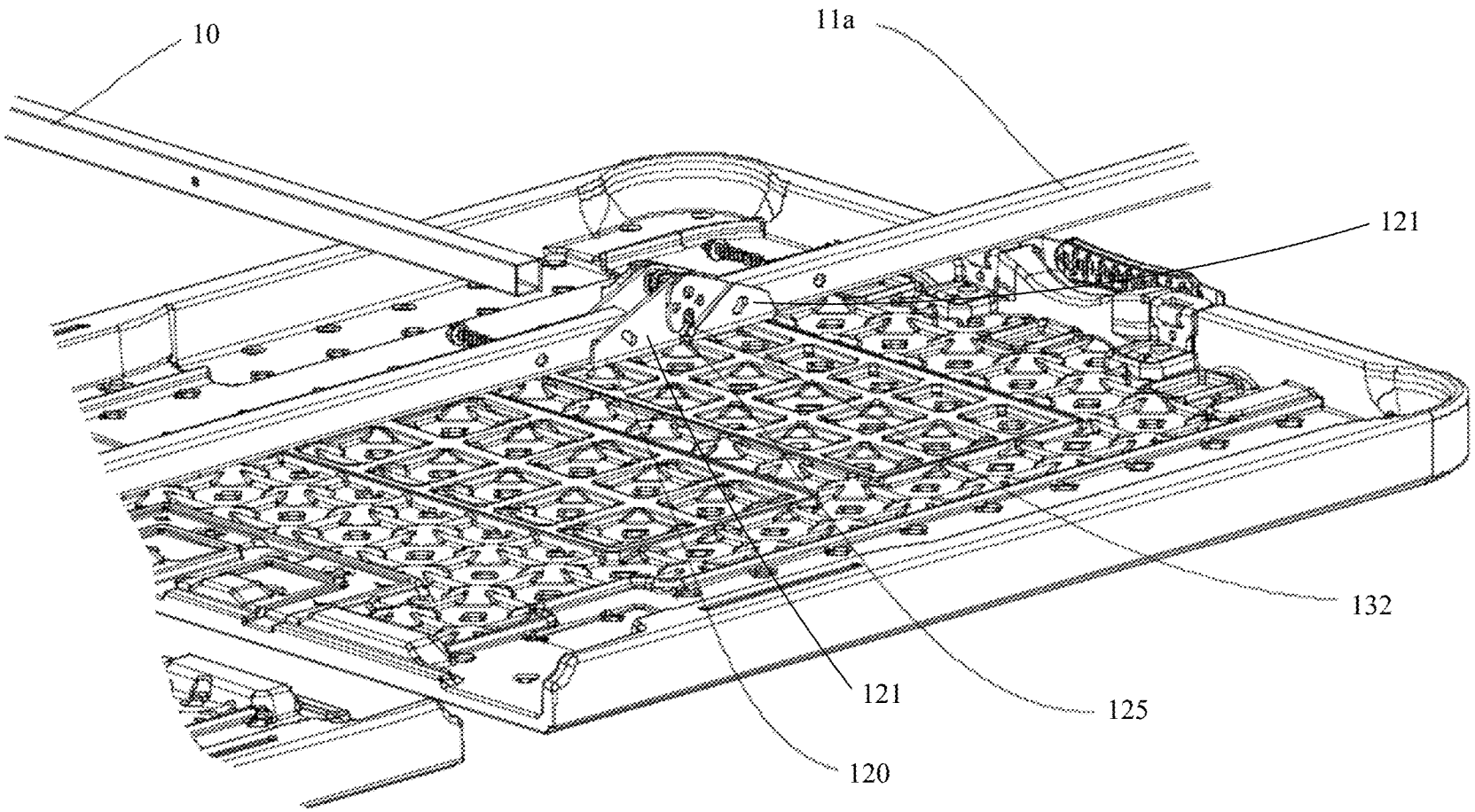
FIG. 2A is a partially enlarged view of FIG. 1B illustrating an exemplary pivoting mechanism in an unlocked state in accordance with exemplary embodiments of the present disclosure.
Figure 2B:
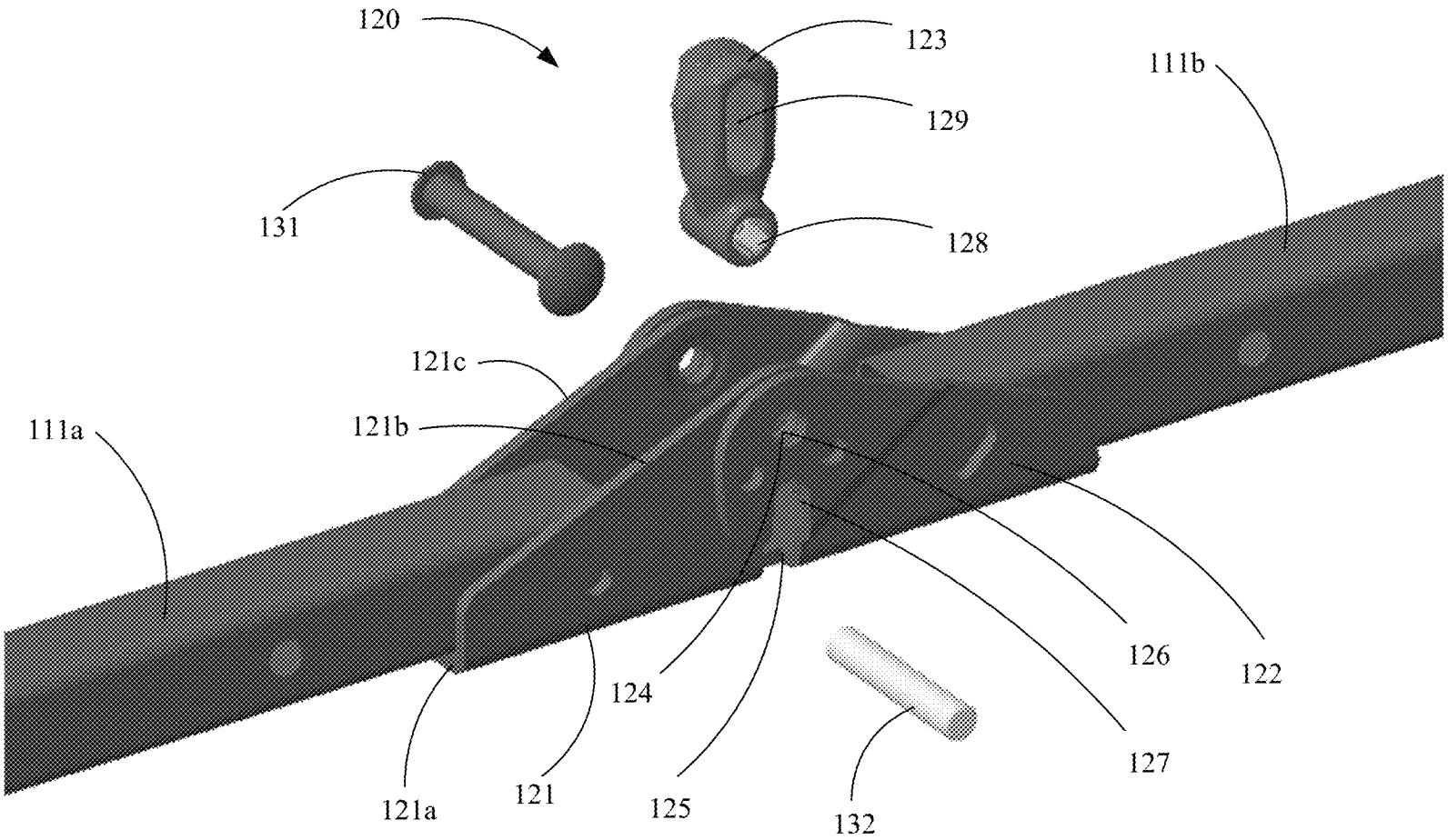
FIG. 2B is a partially disassembled view illustrating an exemplary pivoting mechanism in an unlocked state in accordance with exemplary embodiments of the present disclosure.

Pivoting mechanism 120 selectively allows the first and second coupling pieces to rotate with respect to each other, and accordingly selectively allows the first and second bars to fold and unfold. For instance, when the first and second coupling pieces are aligned with each other and the open top of the second slot of the second coupling piece faces downwardly as illustrated in FIGS. 2A and 2B (corresponding to a table placed upside-down table as illustrated in FIG. 1A), the gravity pulls down the third coupling piece together with the second rod to a first position. At the first position, second rod 132 is disposed outside of the slot of the second coupling piece. That is, the second rod is disposed only in the slot of the first coupling piece. As such, at this first position, the first and second coupling pieces are allowed to rotate with respect to each other around the first rod. Consequently, first bar 111*a* and second bar 111*b* are allowed to rotate with respect to each other, thereby allowing the table to fold. In some exemplary embodiments, at the first position, first rod 131 is disposed adjacent to the bottom of the slot of the third coupling piece.

Figure 2C:
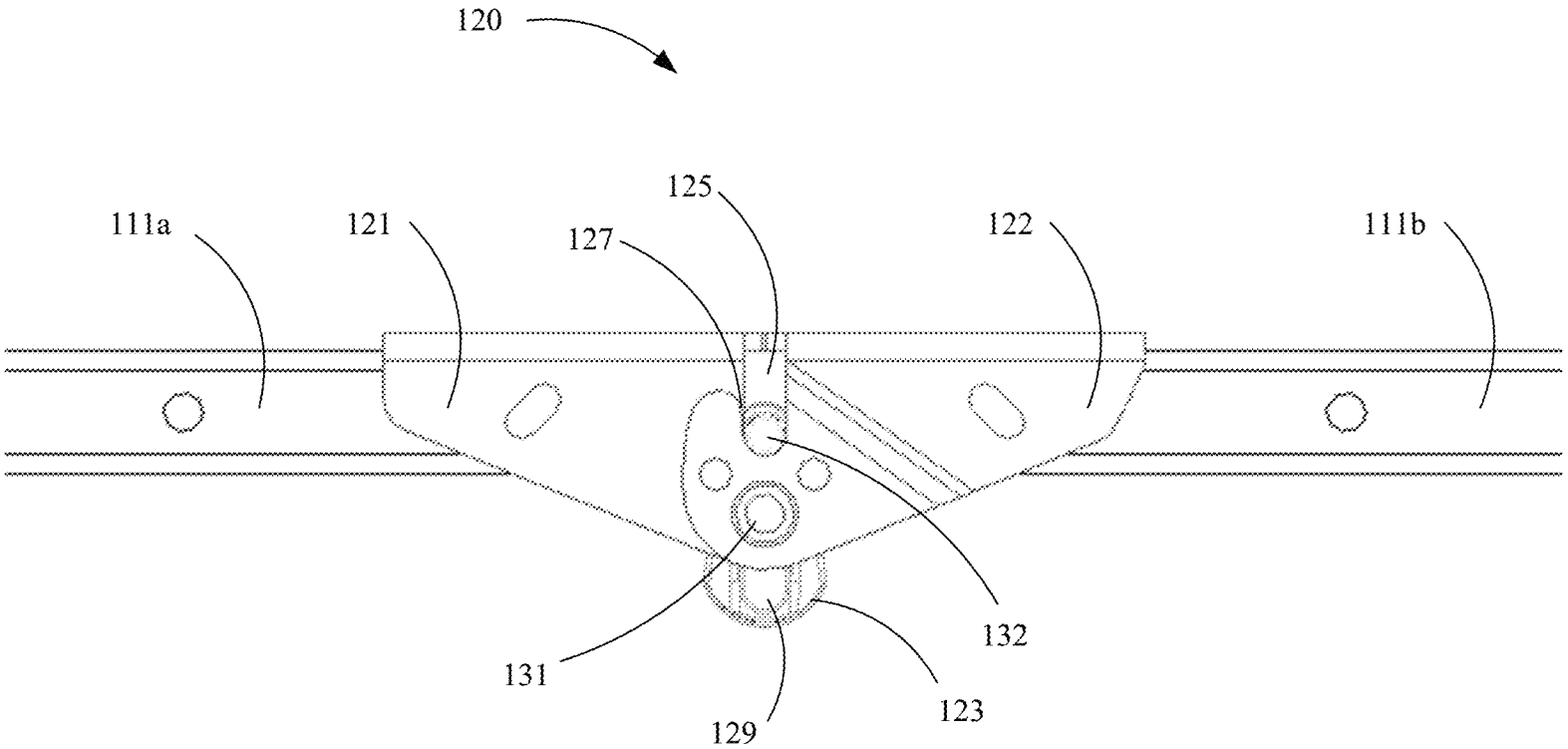
FIG. 2C is a schematic side view illustrating an exemplary pivoting mechanism in a locked state in accordance with exemplary embodiments of the present disclosure.

When the first and second coupling pieces are aligned with each other and the open top of the second slot of the second coupling piece faces upwardly as illustrated in FIG. 2C (corresponding to a table placed upright), the gravity again pulls down the third coupling piece together with the second rod, moving them to a second position. At the second position, second rod 132 is disposed in the slot (e.g., adjacent to the bottom of the slot) of the second coupling piece. That is, the second rod is disposed not only in the slot of the first coupling piece but also in the slot of the second coupling piece. As such, at this second position, the first and second coupling pieces are restricted from rotating with respect to each other around the first rod. Consequently, first bar 111*a* and second bar 111*b* are restricted from rotating with respect to each other, thereby preventing accidental unfolding of the table. In some exemplary embodiments, at the second position, first rod 131 is disposed adjacent to the top of the third slot of the third coupling piece.

Figure 3B:
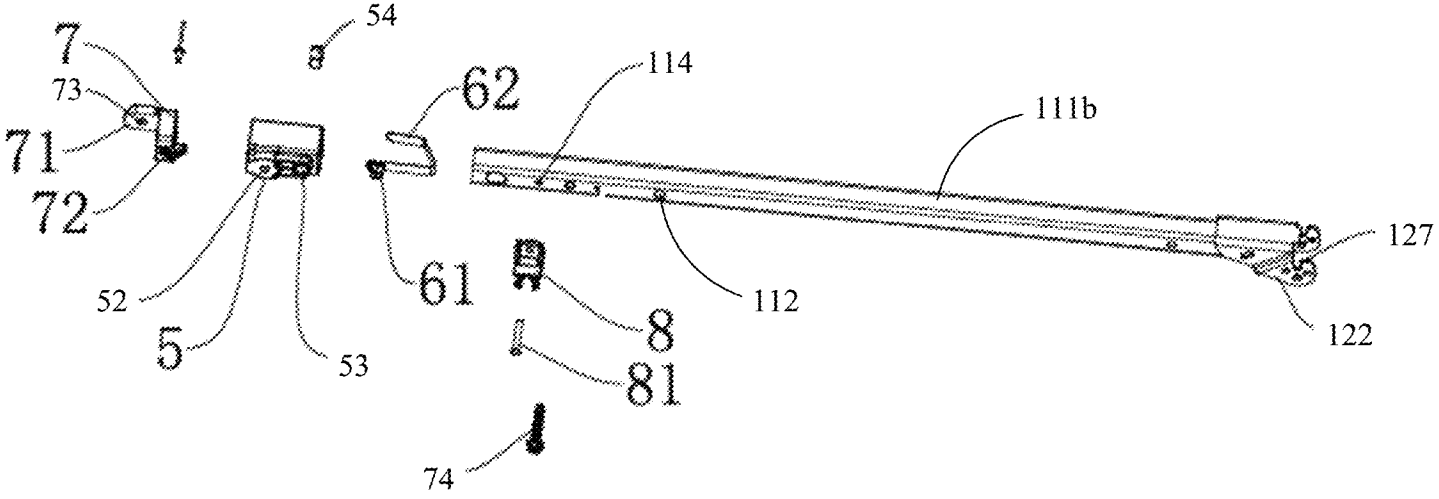
FIG. 3B is a partially disassembled view of FIG. 3A.
Figure 3C:
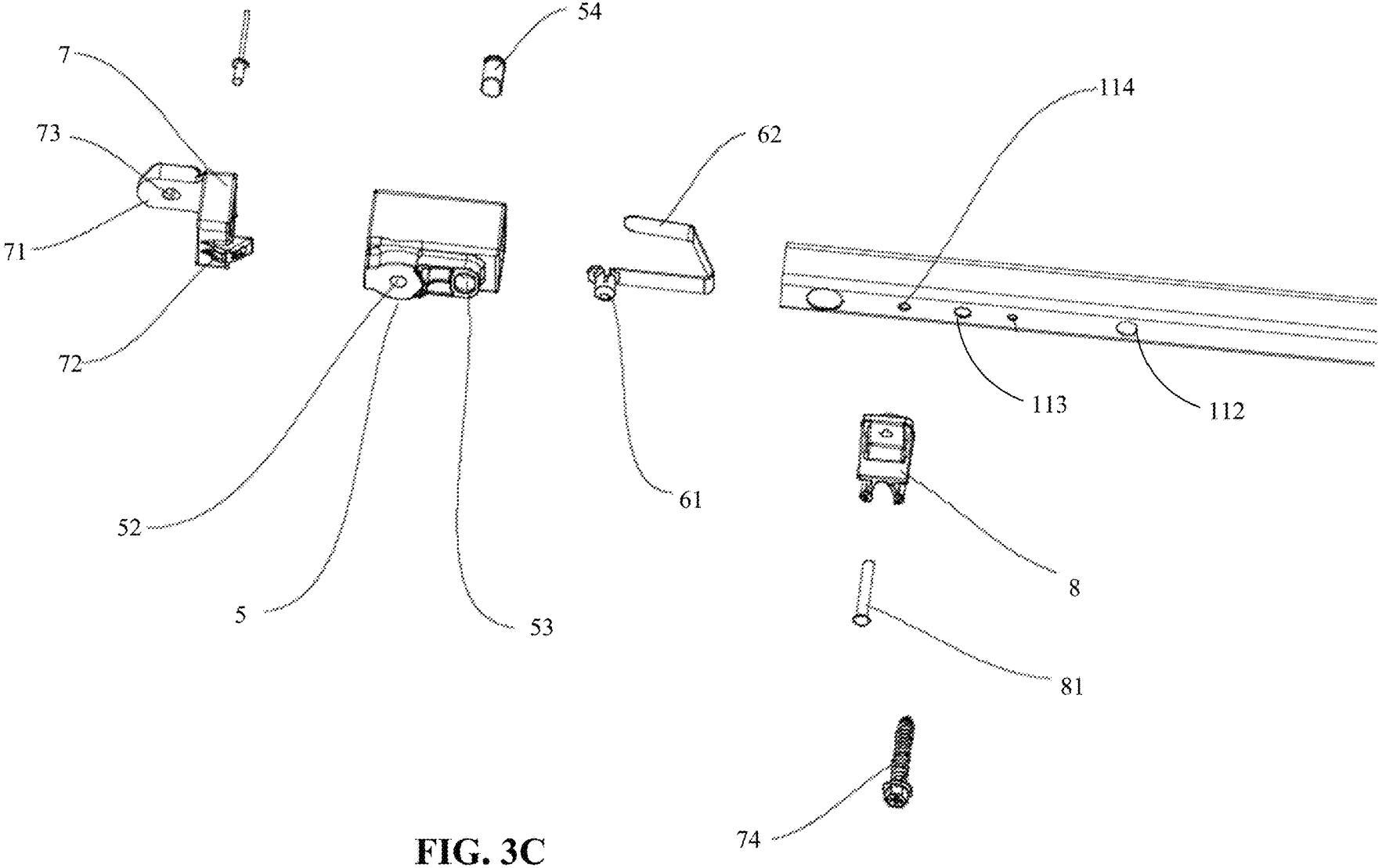
FIG. 3C is a partially enlarged view of FIG. 3B.
Figure 3D:
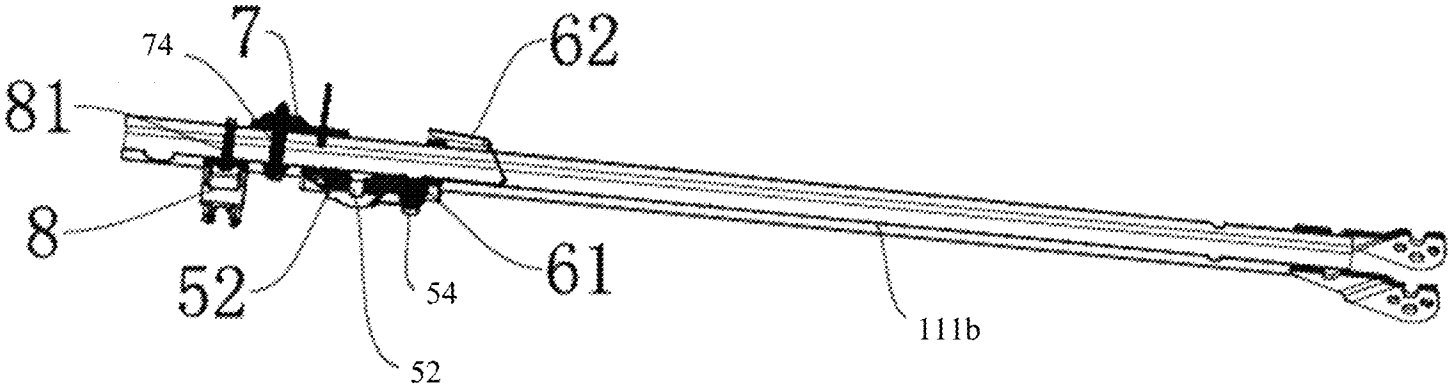
FIG. 3D is a partially cutout view illustrating an exemplary sliding mechanism in a locked state in accordance with exemplary embodiments of the present disclosure.
Figure 3E:
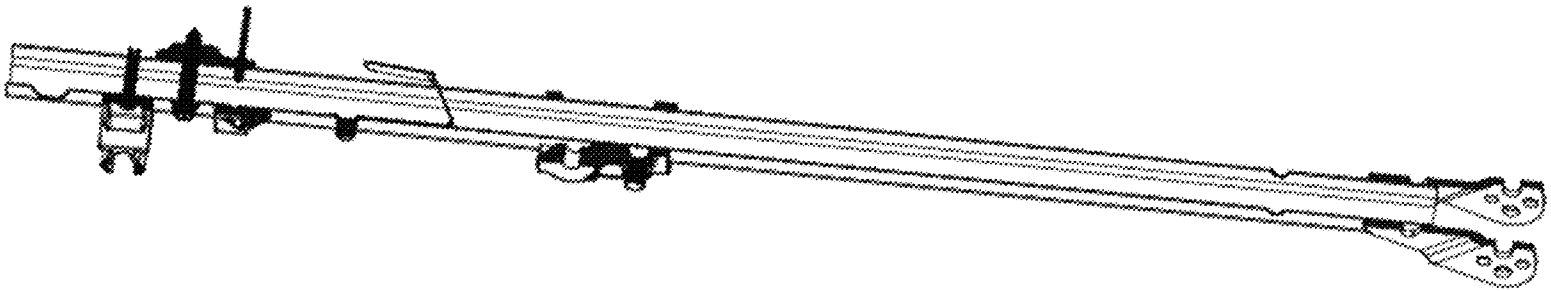
FIG. 3E is a partially cutout view illustrating an exemplary sliding mechanism in an unlocked state in accordance with exemplary embodiments of the present disclosure.

In some exemplary embodiments, when the first and second coupling pieces are aligned with each other, slot 135 of the first coupling piece and slot 139 of the third coupling piece are aligned with each other in the first direction as illustrated in FIG. 3C.

In some exemplary embodiments, the first and second coupling pieces includes a horizontal piece, a first lug at a first side of the horizontal piece and a second lug at a second side of the horizontal piece. The first and second lugs are substantially parallel to each other. In such exemplary embodiments, each of the first and second lugs is formed with a corresponding first or second slot. For instance, first coupling piece 121 includes horizontal piece 121*a*, first lug 121*b* and second lug 121*c*. First lug 121*b* is disposed at a first side of horizontal piece 121*a* and second lug 121*c* is disposed at a second side of horizontal piece 121*a*. First lug 121*b* and second lug 121*c* are substantially parallel to each other. Each of first lug 121*b* and second lug 121*c* is formed with slot 135.

In some exemplary embodiments, at least a portion of the third coupling piece is disposed between the first and second lugs of the first coupling piece, and at least a portion of the first and second lugs of the first coupling piece is disposed between the first and second lugs of the second coupling piece.

Referring back to FIGS. 1A and 1B, in some exemplary embodiments, frame 1 includes a first lateral bar, such as first lateral bar 12*a*, disposed at a third side of the frame and a second lateral bar, such as second lateral bar 12*b*, disposed at a fourth side of the frame. In some exemplary embodiments, each of the first and second lateral bars has a first end pivotally coupled with the first longitudinal bar and a second end pivotally coupled with the second longitudinal bar.

In some exemplary embodiments, frame 1 includes one or more interior lateral bars spaced apart from the first and second lateral bars, and each interior lateral bar has a first end coupled with the first longitudinal bar and a second end coupled with the second longitudinal bar. For instance, in some exemplary embodiments, frame 1 includes an interior lateral bar, such as third lateral bar 10, disposed between the first and second lateral bars. In an exemplary embodiment, third lateral bar 10 is disposed in the middle of the frame, having a first end coupled with the pivoting mechanism at the first side of the frame and a second end coupled with the pivoting mechanism at the second side of the frame. It should be noted that the term "middle" as used herein does not necessarily mean the center of the frame.

In some exemplary embodiments, frame 1 includes a plurality of legs, such as legs 3, each having an end fixedly coupled with the first or second lateral bar. For instance, in an exemplary embodiment, frame 1 includes four legs, two coupled with the first lateral bar and two coupled with the second lateral bar. In some exemplary embodiments, each leg has an upper leg and a lower leg telescopically coupled with each other. For instance, in an exemplary embodiment, leg 3 has upper leg 32 and lower leg 31 that are telescopically coupled with each other by a locking/unlocking mechanism such as locking/unlocking mechanism 33.

To enhance the strength and stability of the table, in some exemplary embodiments, frame 1 includes a plurality of oblique bars, such as oblique bar 4, and a plurality of sliding mechanisms, such as sliding mechanism 140. For instance, in an exemplary embodiment, frame 1 includes four oblique bars 4 and four sliding mechanisms 140. Each oblique bar 4 has one end pivotally coupled with a corresponding leg and the other end pivotally coupled with a corresponding sliding mechanism that is slidably coupled with the first or second longitudinal bar.

Referring to 1A-1B and 3A-3E, in some exemplary embodiments, sliding mechanism 140 includes a slider, such as slider 5, configured to be slidable along first longitudinal bar 11*a* or second longitudinal bar 11*b*. For instance, in some exemplary embodiments, slider 5 includes a sleeve, such as sleeve 51, configured to slidably couple with first longitudinal bar 11*a* or second longitudinal bar 11*b*. It should be noted that the sleeve can couple with any suitable bars including but not limited the first and second longitudinal bars disclosed herein, and accordingly sliding mechanism 140 can be used in applications including but not limited to table frames disclosed herein. For instance, sliding mechanism 140 can be used in other furniture such as chairs, beds or the like.

In some exemplary embodiments, slider 5 includes a pivoting portion, such as pivoting portion 52, configured to pivotally couple with a bar such as oblique bar 4. In some exemplary embodiments, the pivoting portion is formed or coupled with the sleeve. For instance, in an exemplary embodiment, the pivoting portion is a protrusion or a hole formed at the sleeve. In some exemplary embodiments, one or more pivoting portions are formed or coupled with the sleeve to pivotally couple with one or more bars.

In some exemplary embodiments, a restriction hole, such as restriction hole 53, is formed at the sleeve. In some exemplary embodiments, slider 5 includes a push button, such as push button 54, movably coupled with the restriction hole of the slider, such that the push button or at least a portion of the push button can be inserted into the restriction hole of the slider.

In some exemplary embodiments, sliding mechanism 140 includes a locking member, such as a locking member 6, that selectively restricts the sleeve of the slider from moving with respect to the first or second longitudinal bar. For instance, in some exemplary embodiments, the first or second longitudinal bar is a hollow bar, or at least a portion of the first or second longitudinal bar is hollow. A first restriction hole, such as restriction hole 112 is formed at a side wall of the hollow portion of the first or second longitudinal bar. Restriction hole 53 formed at the sleeve of the slider corresponds to restriction hole 112 formed at the first or second longitudinal bar. Locking member 6 includes an elastic piece, such as elastic piece 62, configured to be disposed in the hollow portion of the first or second longitudinal bar restriction hole 112.

Locking member 6 also includes a restriction piece, such as restriction piece 61, formed or coupled with the elastic piece. The elastic piece pushes the restriction piece outwardly. When the restriction hole formed at the sleeve is aligned with the restriction hole formed at the first or second longitudinal bar, the elastic piece pushes the restriction piece into the restriction hole formed at the first or second longitudinal bar and the restriction hole formed at the sleeve. As such, the restriction piece engages the first or second longitudinal bar with the sleeve and thus restricts the sleeve from moving along the first or second longitudinal bar. Pressing the push button will push the restriction piece inwardly, disengage the position piece from the restriction hole formed at the sleeve, and thus allow the sleeve to move along the first or second longitudinal bar.

The elastic piece of the locking member can be made of any suitable materials, including but not limited to plastics and metals. The elastic piece of the locking member can also have any suitable configurations (e.g., shapes, sizes). In some exemplary embodiments, the elastic piece of the locking member includes a plurality of portions. For instance, in an exemplary embodiment, the elastic piece includes two portions forming a "V" shape. In another exemplary embodiment, the elastic piece includes first, second and third portions with the second portion bended with respect to the first portion and the third portion bended with respect to the second portion as illustrated in FIGS. 3B and 3C. The bended elastic piece can be made, for instance, by bending a metal strip, molding a plastic, or the like. In some exemplary embodiments, the restriction piece is coupled or formed with the elastic piece at a location adjacent to an end of the elastic piece.

In some exemplary embodiments, frame 1 includes a plurality of positioning pieces, such as positioning piece 7. Each positioning piece is fixedly coupled with a longitudinal bar (e.g., the first or second longitudinal bar) at a position between a lateral bar (e.g., the first or second lateral bar) and a corresponding sliding mechanism. Each positioning piece is configured to help align restriction hole 53 formed at the sleeve of the corresponding sliding mechanism with restriction hole 112 formed at the longitudinal bar. For instance, in some exemplary embodiments, positioning piece 7 includes an extension, such as extension 71, and a sloped protrusion, such as protrusion 72. The extension of the positioning piece is fixedly coupled with the longitudinal bar, for instance, by fastener 74 through hole 73 formed at the extension and hole 113 formed at the first or second longitudinal bar. The sloped protrusion of the positioning piece is configured to engage with a sloped surface formed at the sleeve of the corresponding sliding mechanism, to facilitate alignment of restriction hole 53 formed at the sleeve of the corresponding sliding mechanism with restriction hole 112 formed at the longitudinal bar. At this position, the restriction piece, pushed by the elastic piece, protrudes outwardly into the restriction holes and engage the longitudinal bar with the sleeve. As a result, the sleeve of the slider is restricted from moving along the longitudinal bar, and the leg is locked. In other words, with the positioning pieces, it is quick, simple and convenient to unfold and lock the legs. In addition, each positioning piece sets a limit and prevents the slider of the corresponding sliding mechanism from moving further toward the lateral bar. In other words, the positioning pieces prevent the legs from rotating beyond its unfolded state, and thus enhances the stability of the table when in use.

In some exemplary embodiments, frame 1 includes one or more pairs of couplers, each having a first coupler disposed adjacent to the dismal end of first bar 111*a* and a second coupler disposed adjacent to the dismal end of second bar 111*b*. By way of example, FIGS. 1B and 3A-3E illustrates coupler 8 disposed adjacent to the dismal end of second bar 111*b* and fixedly coupled with second bar 111*b* by fastener 81 through hole 114 formed at second bar 111*b*. When the table is folded, the first and second couplers are engaged with each other, thereby preventing accidental unfolding of the table. In some exemplary embodiments, one of the first and second couplers is a male coupler and the other of the first and second couplers is a female coupler.

Figure 4A:
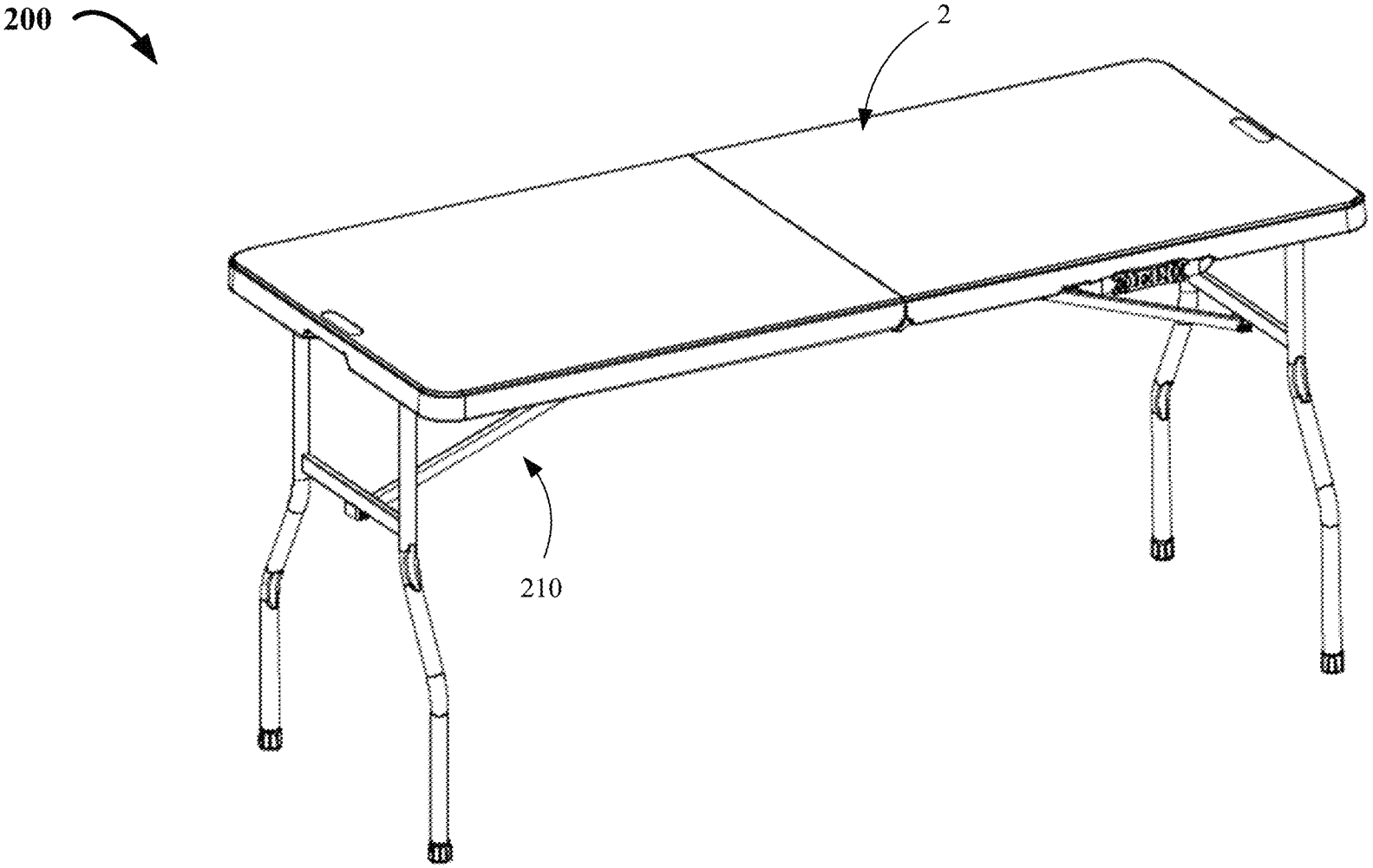
FIG. 4A is a top perspective view illustrating an exemplary table in an unfolded state in accordance with exemplary embodiments of the present disclosure.
Figure 4B:
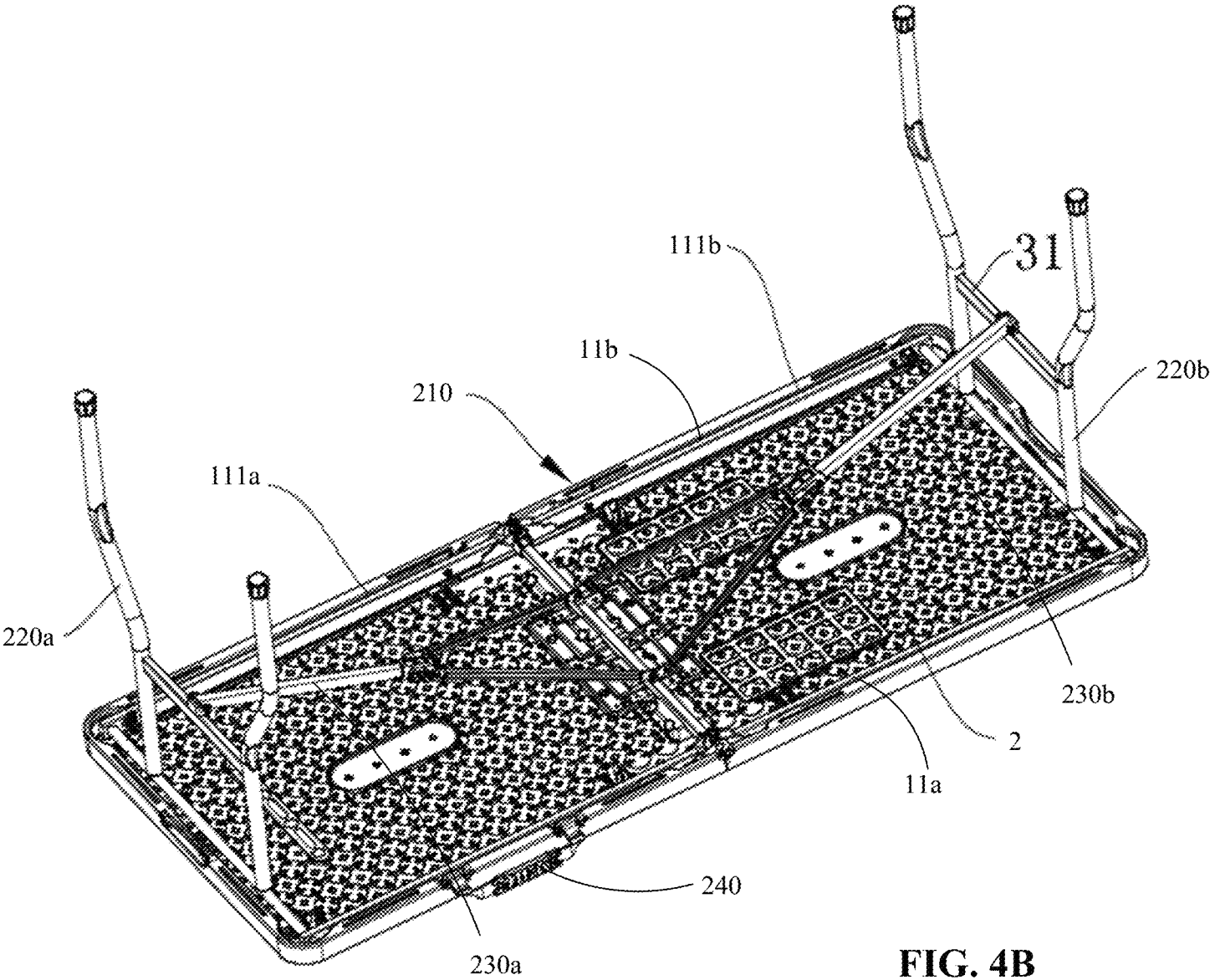
FIG. 4B is a bottom perspective view illustrating the exemplary table of FIG. 4A.
Figure 4C:
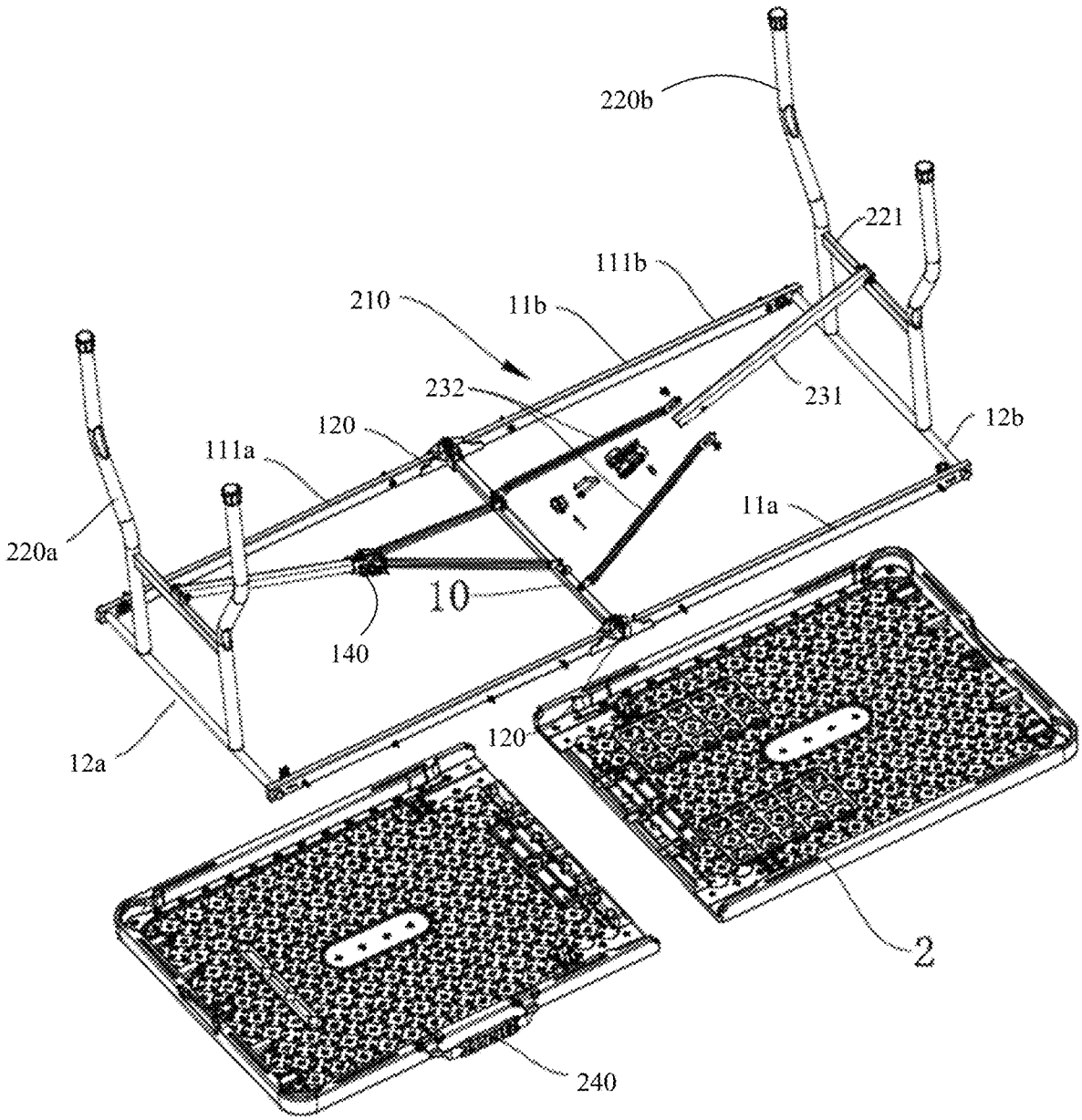
FIG. 4C is a partially disassembled view illustrating the exemplary table of FIG. 4A.
Figure 5A:
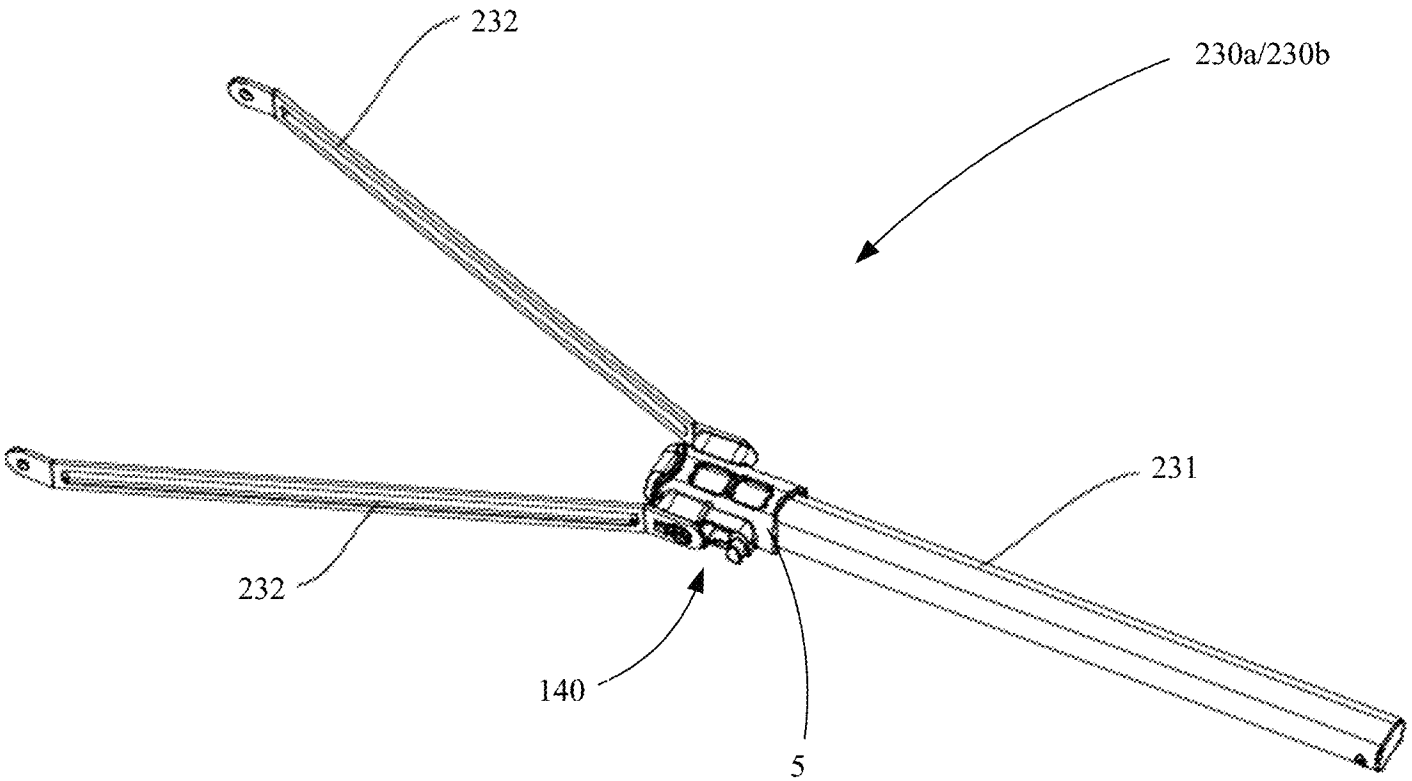
FIG. 5A is a perspective view illustrating an exemplary supporting assembly in accordance with exemplary embodiments of the present disclosure.
Figure 5B:
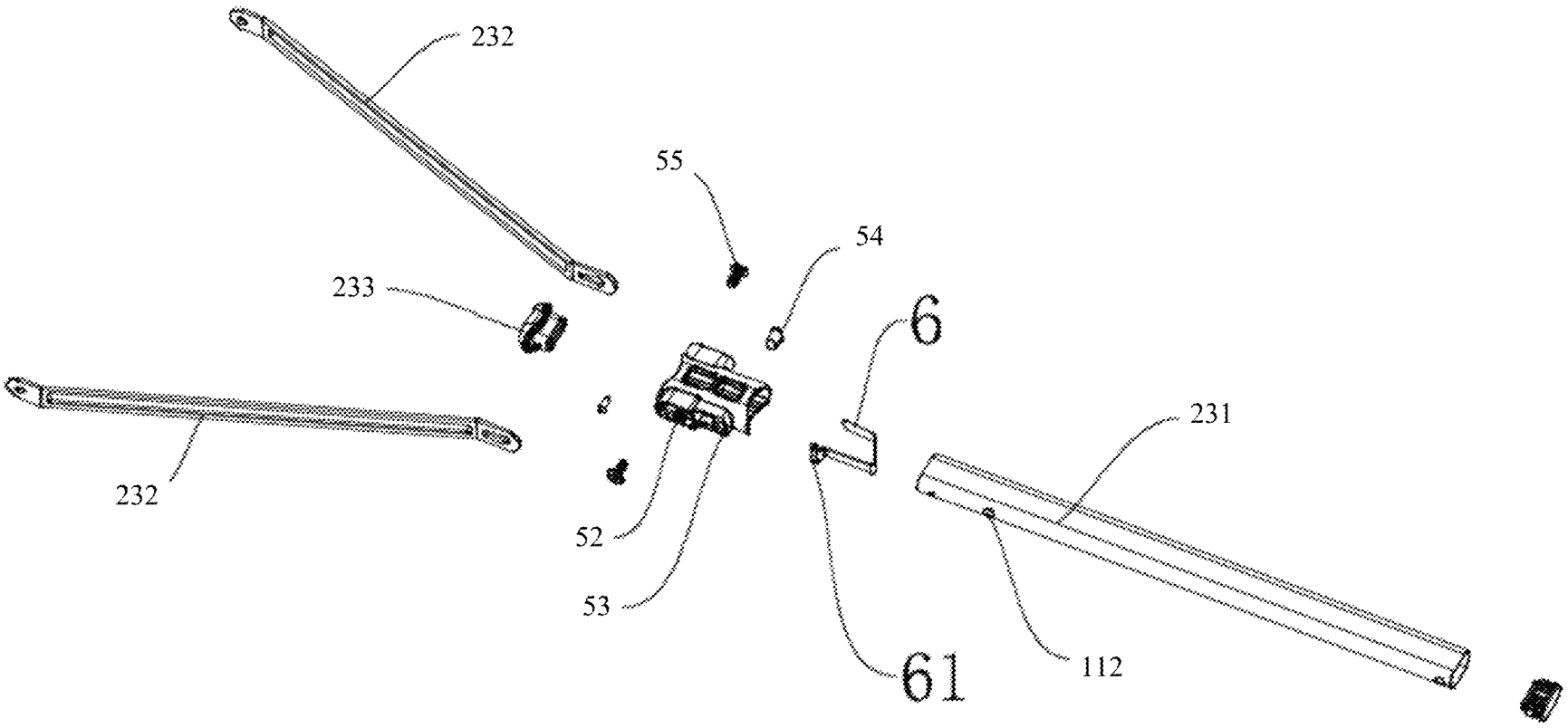
FIG. 5B is a partially disassembled view illustrating the exemplary supporting assembly of FIG. 5A.
Figure 5C:
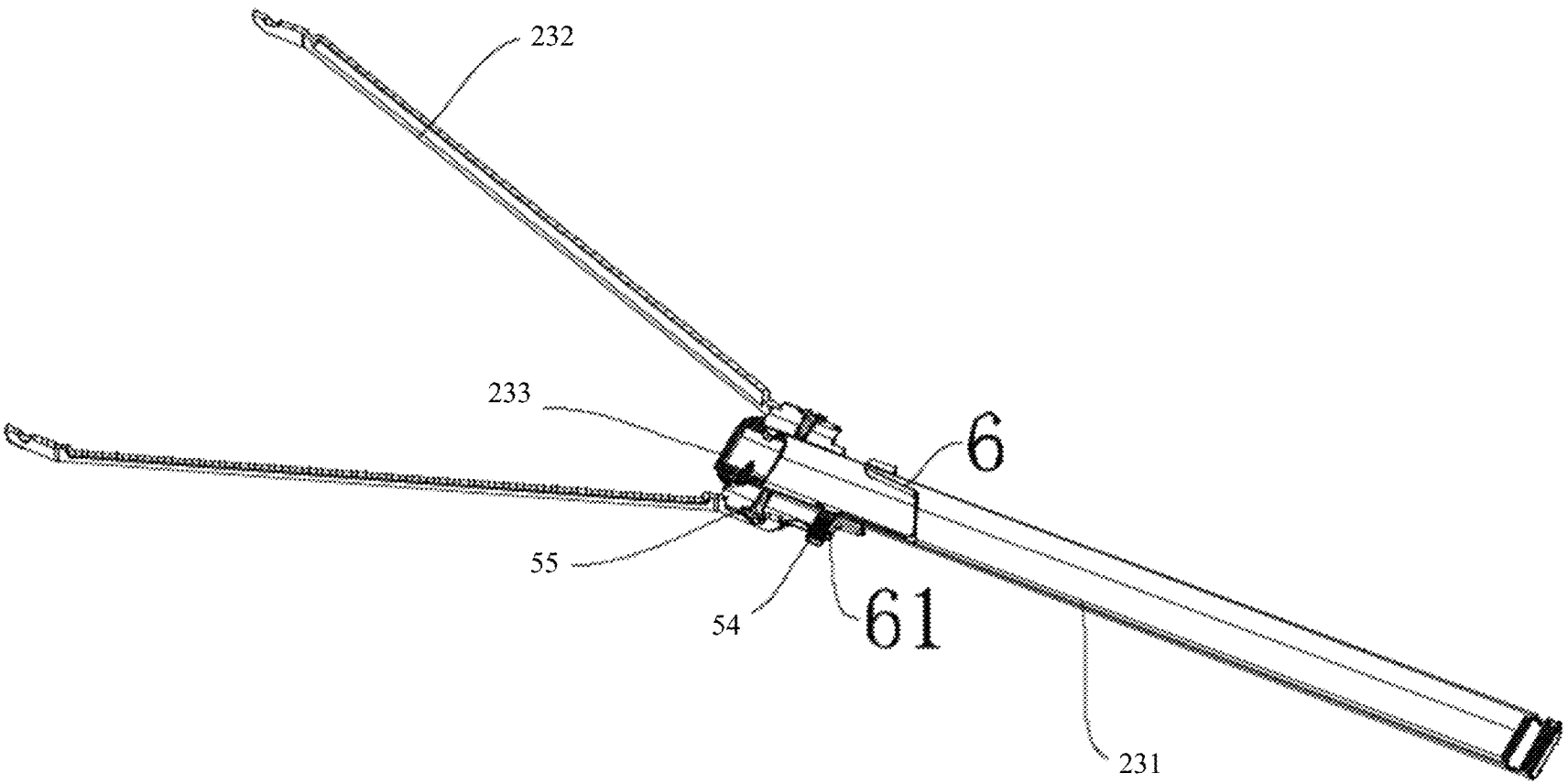
FIG. 5C is a partially cutout view illustrating the exemplary supporting assembly of FIG. 5A.

Referring now to FIGS. 4A-4C, there is depicted an exemplary table in accordance with some embodiments of the present disclosure. As shown, exemplary table 200 includes a tabletop, such as tabletop 2, and a frame, such as frame 210, coupled with the tabletop and supporting the tabletop when in use.

Similar to frame 1, frame 210 includes a first longitudinal bar, such as first longitudinal bar 11*a*, disposed at a first side of the frame and a second longitudinal bar, such as second longitudinal bar 11*b*, disposed at a second side of the frame and substantially parallel to the first longitudinal bar. In some exemplary embodiments, each of the first and second longitudinal bars includes a first bar, such as first bar 111*a*, and a second bar, such as second bar 111*b*. The first and second bars are pivotally coupled with each other at their proximal ends, for instance, by pivoting mechanism 120 disclosed herein. In some exemplary embodiments, frame 210 includes a first lateral bar, such as first lateral bar 12*a*, disposed at a third side of the frame and a second lateral bar, such as second lateral bar 12*b*, disposed at a fourth side of the frame. In some exemplary embodiments, each of the first and second lateral bars has a first end pivotally coupled with the first longitudinal bar and a second end pivotally coupled with the second longitudinal bar. In some exemplary embodiments, frame 210 includes one or more interior lateral bars, such as third lateral bar 10 disposed in the middle of the frame. In some exemplary embodiments, the first longitudinal bar, second longitudinal bar, and third lateral bar are collectively referred as a mounting assembly. In some exemplary embodiments, the first and second longitudinal bars, and the first, second and third lateral bars are collectively referred as a mounting assembly.

In some exemplary embodiments, frame 210 includes a first leg assembly, such as first leg assembly 220*a*, and a second leg assembly, such as second leg assembly 220*b*. The first and second leg assemblies can be but do not necessarily have to be identical or symmetric with respect to each other. By way of example, FIGS. 4A-4C illustrate that the first and second leg assemblies are substantially the same. In some exemplary embodiments, the first leg assembly has an upper end coupled with the mounting assembly at one side of the frame and the second leg assembly has an upper end coupled with the mounting assembly at another side of the frame. For instance, in an exemplary embodiment, the first leg assembly has an upper end coupled with lateral bar 12*a* and the second leg assembly has an upper end coupled with lateral bar 12*b*. In some exemplary embodiments, each of the first and second leg assemblies includes two legs and a leg lateral bar, such as leg lateral bar 221, disposed between and connecting the two legs.

In some exemplary embodiments, frame 210 includes a first supporting assembly, such as first supporting assembly 230*a*, and a second supporting assembly, such as second supporting assembly 230*b*. The first and second supporting assemblies can be but do not necessarily have to be identical or symmetric with respect to each other. By way of example, FIGS. 4B-4C illustrate that the first and second supporting assemblies are substantially the same. The first supporting assembly is pivotally coupled with the mounting assembly and first table leg assembly, and configured to control rotation of the first leg assembly. The second supporting assembly pivotally coupled with the mounting assembly and second table leg assembly, and configured to control rotation of the second leg assembly.

For instance, referring to FIGS. 4C and 5A-5C, in some exemplary embodiments, the first or second supporting assembly includes a first supporting bar, such as first supporting bar 231. One end of the first supporting bar is pivotally coupled with the first or second leg assembly, for instance, pivotally coupled with leg lateral bar 221 of the first or second leg assembly. The first supporting bar, or at least a portion adjacent to another end of the first supporting bar is hollow. A restriction hole, such as restriction hole 112, is formed at a side wall of the hollow portion of the first supporting bar.

In some exemplary embodiments, the first or second supporting assembly also includes a sliding mechanism, such as sliding mechanism 140 disclosed herein. The sleeve of the sliding mechanism is slidably coupled with the first supporting bar and movable along a length direction of the first supporting bar. The elastic piece of the sliding mechanism is disposed in the first supporting bar and adjacent to the first restriction hole formed at the first supporting bar. As such, when the restriction hole formed at the sleeve is aligned with the restriction hole formed at the first supporting bar, the elastic piece of the sliding mechanism pushes the restriction piece outwardly through the restriction hole formed at the first supporting bar and the restriction hole formed at the sleeve. As such, the restriction piece engages the sleeve with the first supporting bar and thus restricts the sleeve from moving along the first supporting bar. Pressing the push button of the sliding mechanism will push the restriction piece inwardly, disengage the position piece from the restriction hole formed at the sleeve, and thus allow the sleeve to move along the first supporting bar.

In some exemplary embodiments, the first or second supporting assembly further includes one or more second supporting bars, such as second supporting bar 232. As a non-limiting example, two second supporting bars are illustrated. Each second supporting bar has an end pivotally coupled with the sleeve of the sliding mechanism, for instance, through pivoting portion 52 and/or fastener 55. Each second supporting bar has another end pivotally coupled with the mounting assembly, for instance, pivotally coupled with third lateral bar 10.

In some exemplary embodiments, the first or second supporting assembly includes additional, optional or alternative components. For instance, in some exemplary embodiments, the first or second supporting assembly includes a positioning piece, such as positioning piece 233. Positioning piece 233 is formed or coupled with the first supporting bar adjacent to an end of the first supporting bar. Positioning piece 233 is configured to help align the restriction hole formed at the sleeve of the sliding mechanism with the restriction hole formed at the first supporting bar or to prevent complete disengagement of the slider of the sliding mechanism from the first supporting bar.

A table of the present disclosure can include additional, optional or alternative components. As a non-limiting example, FIGS. 4A-4C illustrate table 200 having handle 240 to facilitate easy carrying of the table. The handle can be coupled with the tabletop, frame (e.g., longitudinal bar 11*a* or 11*b*), or both of the tabletop and frame. In some exemplary embodiments, table 100 also includes a handle, such as handle 240, to facilitate easy carrying of the table.

Figure 6A:
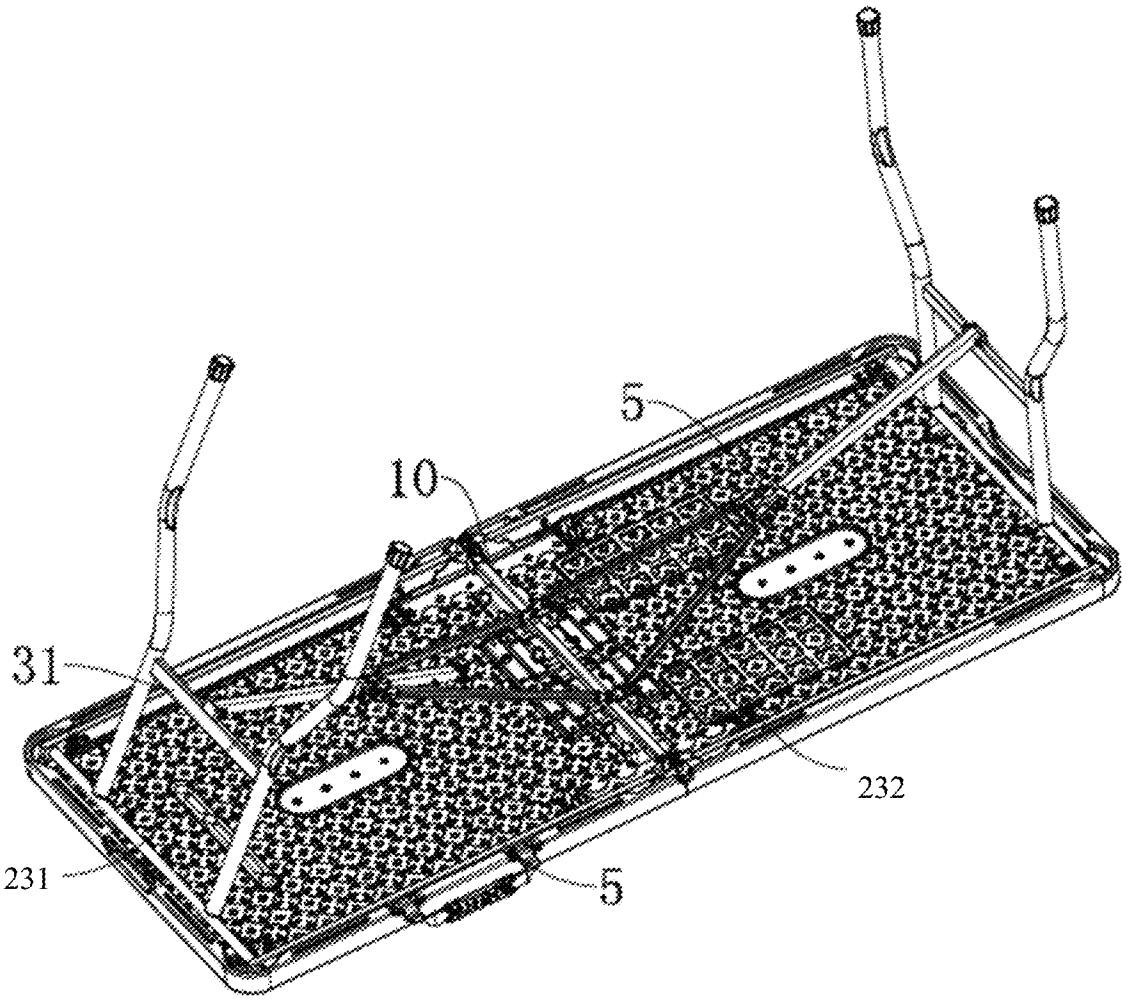
FIG. 6A is a perspective view illustrating the exemplary table of FIG. 4A in a first partially folded state assembly in accordance with exemplary embodiments of the present disclosure.
Figure 6B:
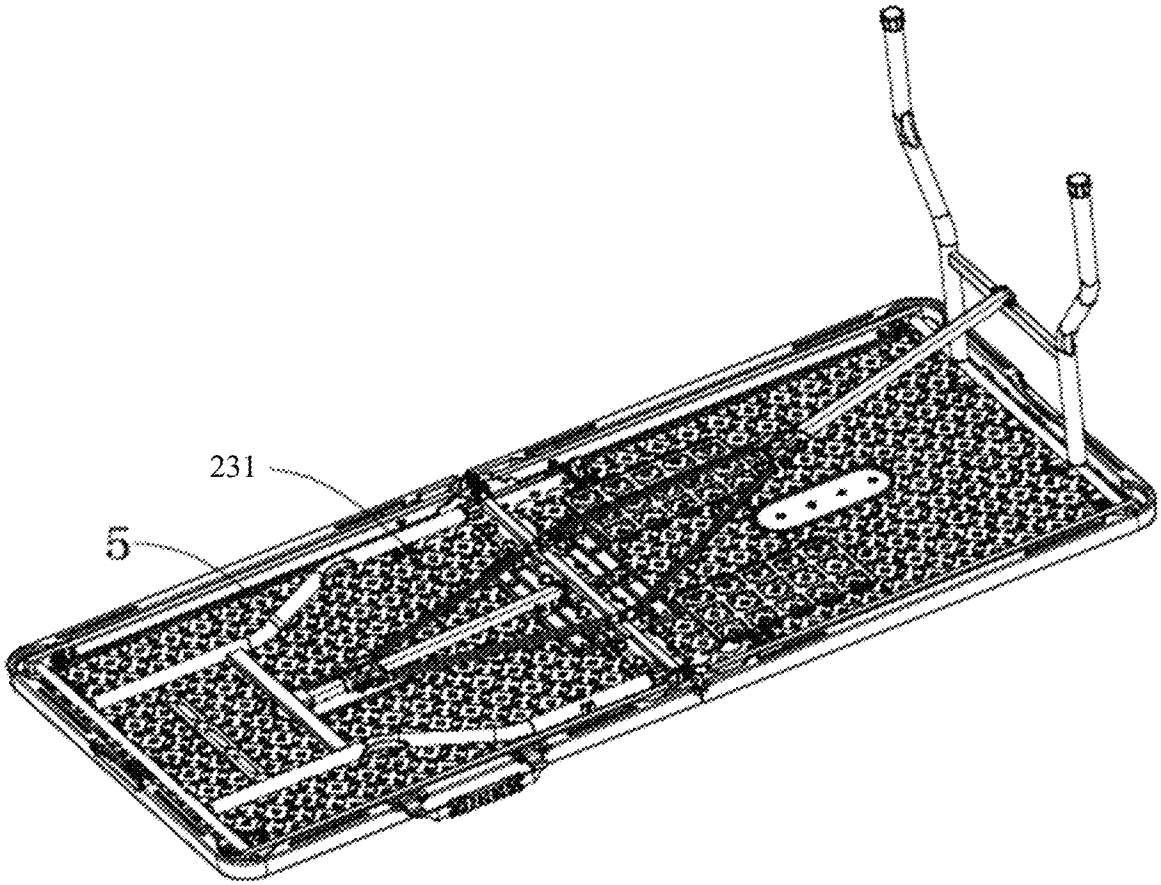
FIG. 6B is a perspective view illustrating the exemplary table of FIG. 4A in a second partially folded state assembly in accordance with exemplary embodiments of the present disclosure.
Figure 6C:
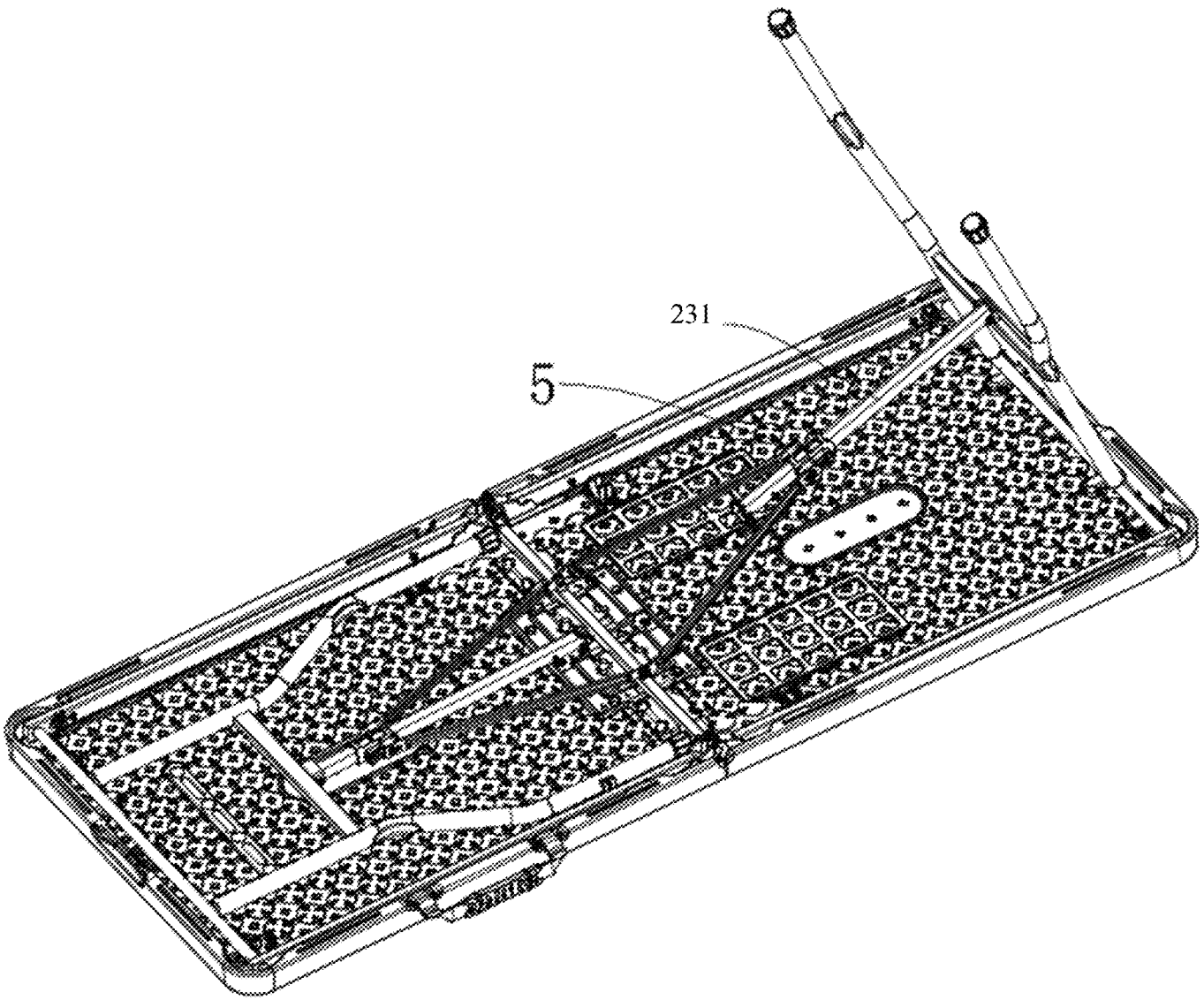
FIG. 6C is a perspective view illustrating the exemplary table of FIG. 4A in a third partially folded state assembly in accordance with exemplary embodiments of the present disclosure.
Figure 6D:
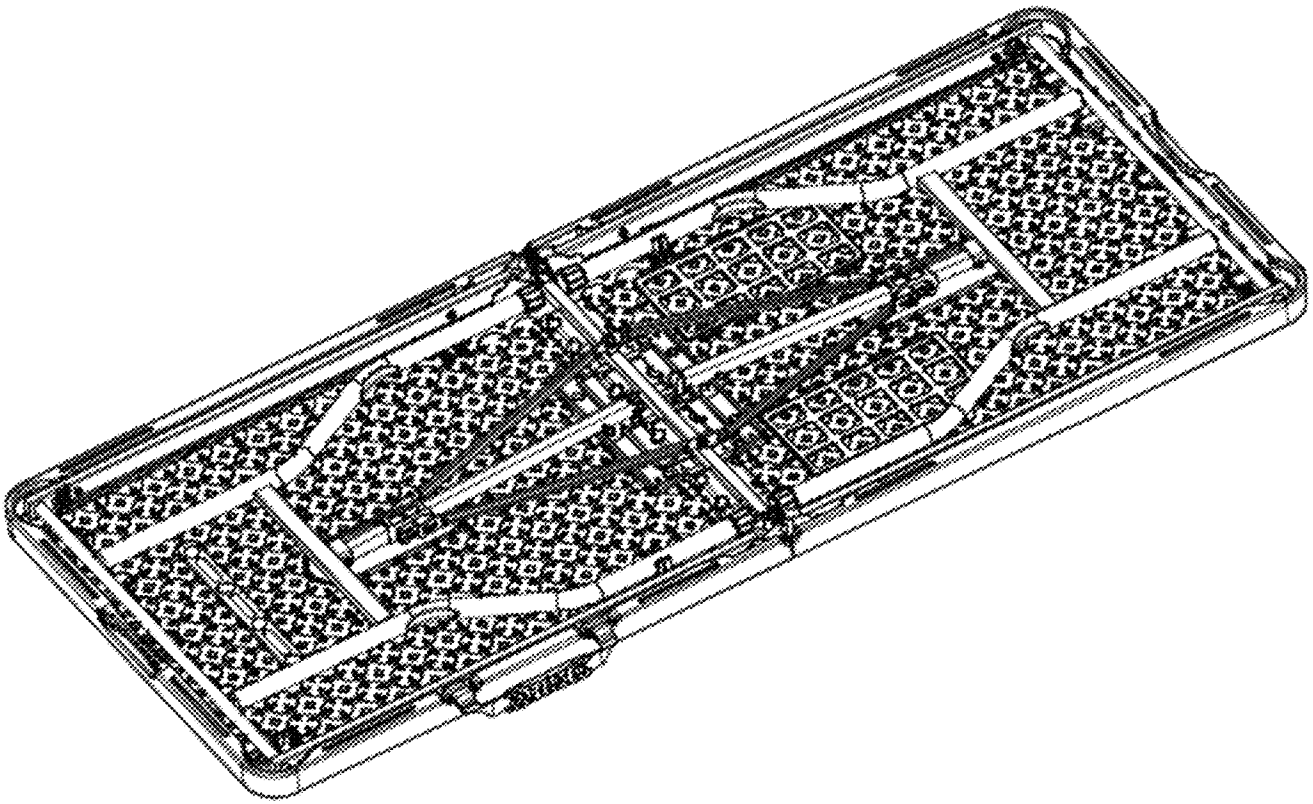
FIG. 6D is a perspective view illustrating the exemplary table of FIG. 4A in a fourth partially folded state assembly in accordance with exemplary embodiments of the present disclosure.
Figure 6E:
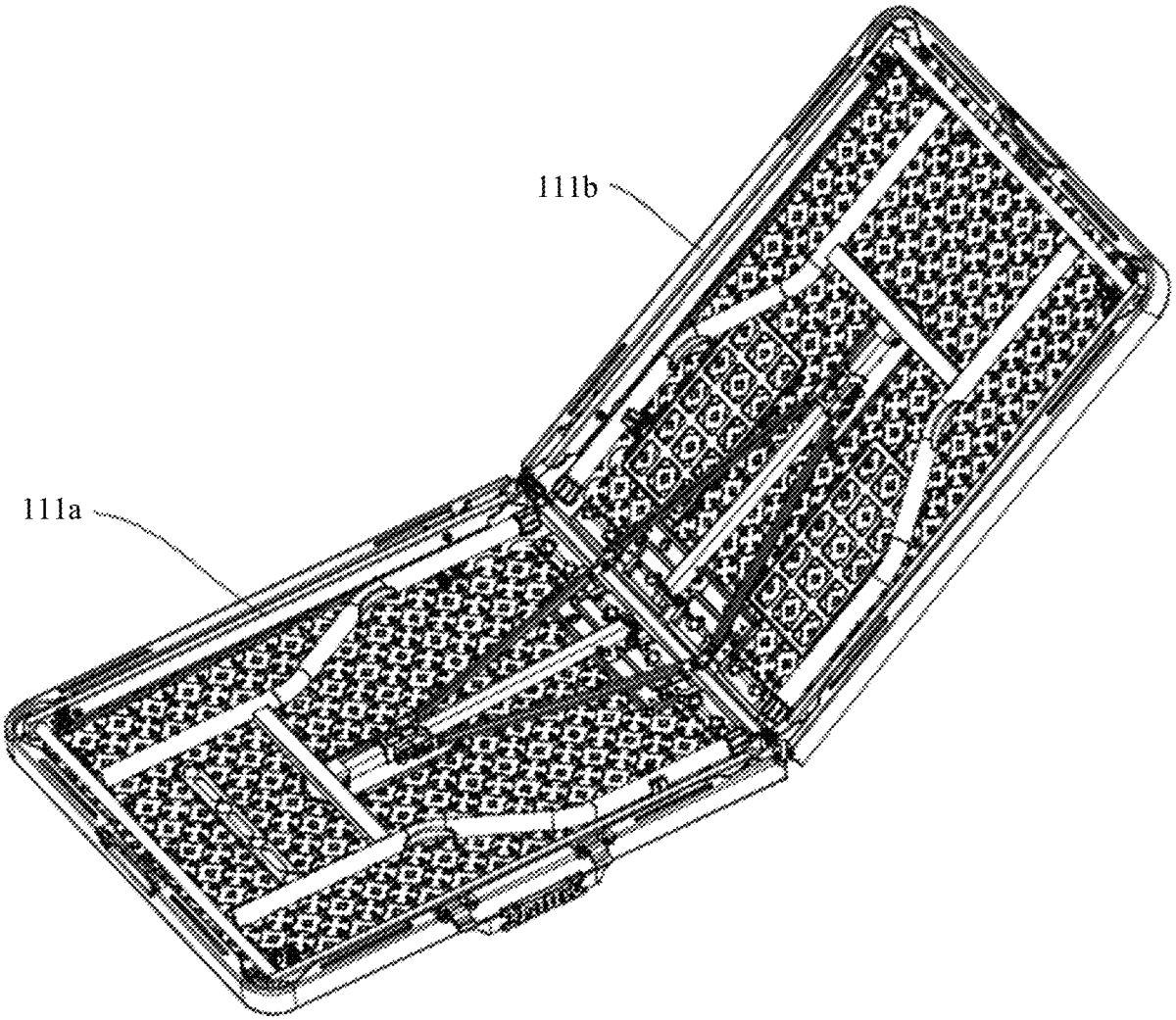
FIG. 6E is a perspective view illustrating the exemplary table of FIG. 4A in a fifth partially folded state assembly in accordance with exemplary embodiments of the present disclosure.
Figure 6F:
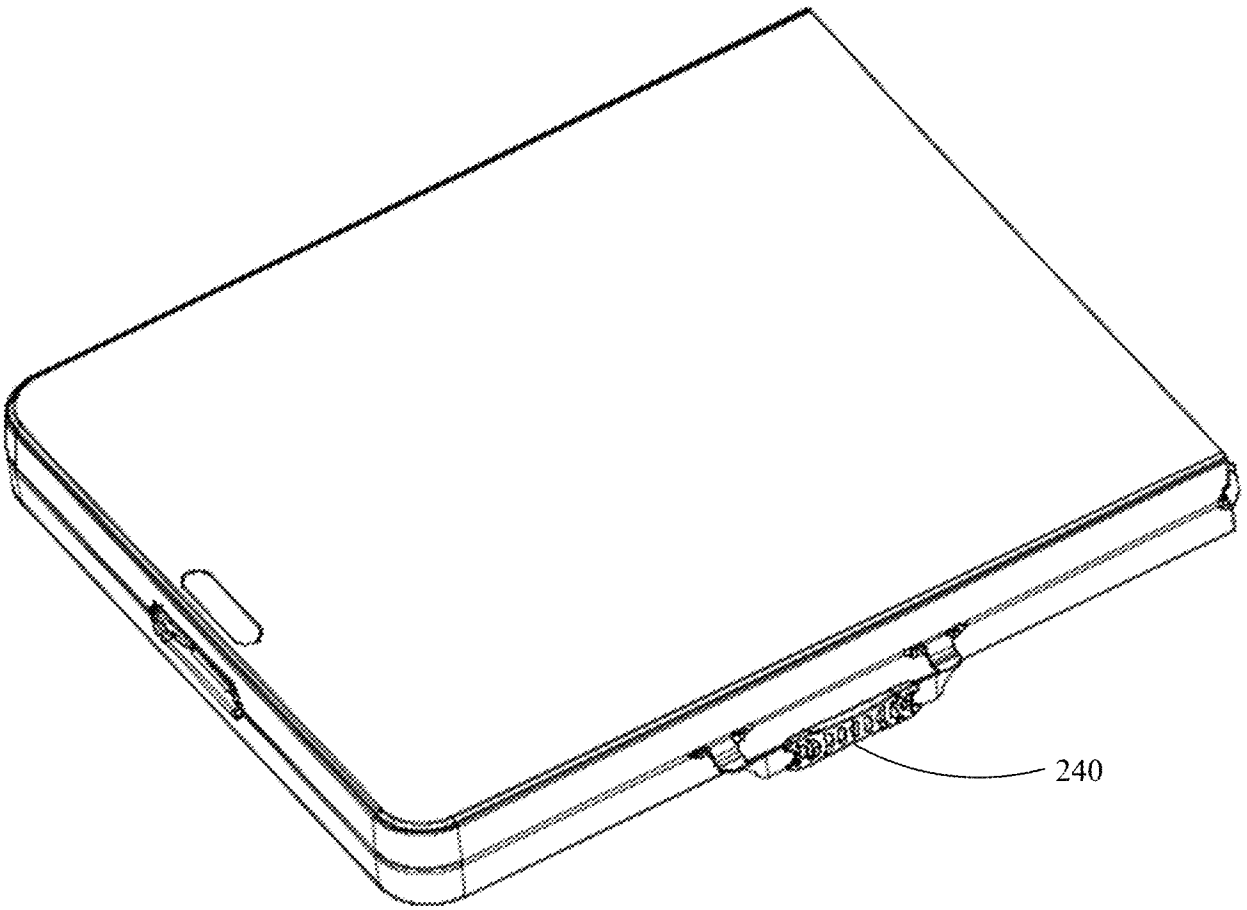
FIG. 6F is a perspective view illustrating the exemplary table of FIG. 4A in a folded state assembly in accordance with exemplary embodiments of the present disclosure.

Referring now to FIGS. 6A-6F, there is depicted an exemplary process to fold an exemplary table in accordance with some embodiments of the present disclosure. For instance, as illustrated in FIGS. 6A-6C, to fold the leg assembly, one can press the push button of the sliding mechanism to push the restriction piece inwardly and thus disengage the position piece from the restriction hole formed at the sleeve. This allows the sleeve to move along the first supporting bar, and accordingly allows the leg assembly to fold. Since the table in FIG. 6D is placed upside down, the second rod of the pivoting mechanism, pulled by the gravity, is disposed outside of the slot of the second coupling piece. This unlocks the first and second coupling pieces of the pivoting mechanism, and thus allows the tabletop and frame to fold as illustrated in FIG. 6E. The resulted folded table in half is illustrated in FIG. 6F. Using the handle, one can easily carry around the folded table.

Reversing the process will unfold the table. For instance, from the folded state illustrated in FIG. 6F, one can first unfold the tabletop and frame as illustrated in FIGS. 6E and 6D. From there, one can unfold the leg assemblies as illustrated in FIGS. 6C, 6B and 6A. As the leg assembly rotates, the sleeve of the slider moves along the first supporting bar until the slider contacts the positioning piece. At this position, the restriction hole formed at the sleeve aligns with the restriction hole formed at the first supporting bar. The elastic piece pushes the restriction piece into the restriction holes formed at the sleeve and first supporting bar, thereby restricting the sleeve from moving along the first supporting bar and locking the leg assembly in the unfolded state.

The frames and tables of the present disclosure have several advantages. For instance, the frames and tables can be folded in half by pivoting mechanisms 120, and thus are convenient for use and transportation. The legs can be folded or unfolded by the control of sliding mechanisms 140, thereby further reducing the sizes of the frames and tables when folded. Moreover, the pivoting mechanism, operated by gravity, automatically locks the frame (e.g., first bar 111*a* and second bar 111*b*) when the table is in use, and thus improves the safety and stability of the table. The sliding mechanism, operated by elastic pieces, automatically locks the leg or leg assembly when it is unfolded, and thus further improves the safety and stability of the table. Furthermore, with the positioning pieces, it is quick, simple and convenient to unfold and lock the legs. Additionally, the height of the legs and consequently the height of the frames and tables can be adjusted using locking/unlocking mechanism 33, and thus can meet different needs of different users.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A sliding mechanism comprising:

a slider comprising:

a sleeve configured to be slidably coupled with a first bar and pivotally coupled with one or more second bars, wherein at least a portion of the first bar is hollow and a first restriction hole is formed at a side wall of the hollow portion of the first bar;

a second restriction hole formed at the sleeve and corresponding to the first restriction hole formed at the first bar; and a push button coupled with the sleeve and insertable into the second restriction hole; and a locking member comprising:

an elastic piece configured to be disposed in the hollow portion of the first bar and adjacent to the first restriction hole formed at the first bar; and a restriction piece formed or coupled with the elastic piece;

wherein when the second restriction hole formed at the sleeve is aligned with the first restriction hole formed at the first bar, the elastic piece pushes the restriction piece outwardly into the first restriction hole formed at the first bar and the second restriction hole formed at the sleeve, thereby restricting the sleeve from moving along the first bar;

wherein the push button is configured to push the restriction piece inwardly to disengage the restriction piece from the second restriction hole formed at the sleeve, thereby allowing the sleeve to move along the first bar.

2. The sliding mechanism of claim 1, wherein the sleeve comprises one or more pivoting portions, each for pivotally coupling an end of a second bar in the one or more second bars.

3. The sliding mechanism of claim 1, wherein the elastic piece of the locking member is a bended piece, and wherein the restriction piece is coupled or formed with the elastic piece at a location adjacent to an end of the elastic piece.

4. A frame comprising:

a first longitudinal bar disposed at a first side of the frame;

a second longitudinal bar disposed at a second side of the frame and substantially parallel to the first longitudinal bar;

a first lateral bar disposed at a third side of the frame and having a first end pivotally coupled with the first longitudinal bar and a second end pivotally coupled with the second longitudinal bar;

a second lateral bar disposed at a fourth side of the frame and having a first end pivotally coupled with the first longitudinal bar and a second end pivotally coupled with the second longitudinal bar;

a plurality of legs, each having an end fixedly coupled with the first or second lateral bar;

a plurality of sliding mechanisms of claim 1, wherein the sleeve of each sliding mechanism is slidably coupled with the first or second longitudinal bar, and the elastic piece of each sliding mechanism is disposed in the first or second longitudinal bar and adjacent to a first restriction hole formed at the first or second longitudinal bar; and a plurality of oblique bars, each having a first end and a second end, wherein the first end is pivotally coupled with a corresponding leg in the plurality of legs, and the second end is pivotally coupled with the sleeve of a corresponding sliding mechanism in the plurality of sliding mechanisms.

5. The frame of claim 4, further comprising a plurality of positioning pieces, wherein each respective positioning piece in the plurality of positioning pieces is fixedly coupled with the first or second longitudinal bar at a position to help align the second restriction hole formed at the sleeve of a corresponding sliding mechanism in the plurality of sliding mechanisms with a first restriction hole formed at the first or second longitudinal bar.

6. The frame of claim 5, wherein each respective positioning piece is formed with a sloped protrusion to engage with a sloped surface formed at the sleeve of the corresponding sliding mechanism.

7. The frame of claim 4, wherein each of the first and second longitudinal bars comprises a first bar and a second bar pivotally coupled with each other at their proximal ends by a pivoting mechanism.

8. The frame of claim 7, wherein for each of the first and second longitudinal bars, the frame further comprises:

a first coupler disposed adjacent to a distal end of the first bar; and a second coupler disposed adjacent to a distal end of the second bar;

wherein when the first and second bars are folded onto each other, the first and second couplers are engaged with each other, thereby preventing the first and second bars from accidental unfolding.

9. A frame comprising:

a mounting assembly;

a first leg assembly having an upper end coupled with the mounting assembly at one side of the frame;

a second leg assembly having an upper end coupled with the mounting assembly at another side of the frame;

a first supporting assembly pivotally coupled with the mounting assembly and first table leg assembly to control rotation of the first leg assembly; and a second supporting assembly pivotally coupled with the mounting assembly and second table leg assembly to control rotation of the second leg assembly;

wherein each of the first and second supporting assemblies comprises:

a first supporting bar, wherein at least a portion of the first supporting bar is hollow and a first restriction hole is formed at a side wall of the hollow portion of the first supporting bar;

the sliding mechanism of claim 1, wherein the sleeve of the sliding mechanism is slidably coupled with the first supporting bar and movable along a length direction of the first supporting bar, and wherein the elastic piece of the sliding mechanism is disposed in the first supporting bar and adjacent to the first restriction hole formed at the first supporting bar; and one or more second supporting bars, each having a first end pivotally coupled with the sleeve of the sliding mechanism.

10. The frame of claim 9, wherein the mounting assembly comprises:

a first longitudinal bar disposed at a first side of the frame;

a second longitudinal bar disposed at a second side of the frame and substantially parallel to the first longitudinal bar; and first, second and third lateral bars, each having a first end coupled with the first longitudinal bar and a second end coupled with the second longitudinal bar, wherein the first lateral bar is disposed at a third side of the frame, the second lateral bar is disposed at a fourth side of the frame, and the third lateral bar is disposed between the first and second lateral bar;

wherein:

the first leg assembly has an upper end coupled with the first lateral bar and is rotatable with respect to the first and second longitudinal bars;

the second leg assembly has an upper end coupled with the second lateral bar and rotatable with respect to the first and second longitudinal bars;

the first supporting assembly is pivotally coupled with the third lateral bar and first table leg assembly to control rotation of the first leg assembly with respect to the first and second longitudinal bars; and the second supporting assembly is pivotally coupled with the third lateral bar and second table leg assembly to control rotation of the second leg assembly with respect to the first and second longitudinal bars.

11. The frame of claim 10, wherein the first restriction hole is formed adjacent to a first end of the first supporting bar;

a second end of the first supporting bar is pivotally coupled with the first or second leg assembly; and a second end of each second supporting bar in the one or more second supporting bars is pivotally coupled with the third lateral bar.

12. The frame of claim 11, wherein each of the first and second supporting assemblies further comprises a positioning piece formed or coupled with the first supporting bar adjacent to the first end thereof to help align the second restriction hole formed at the sleeve of the sliding mechanism with the first restriction hole formed at the first supporting bar or to prevent complete disengagement of the slider of the sliding mechanism from the first supporting bar.

13. The frame of claim 9, wherein each of the first and second longitudinal bars comprises a first bar and a second bar pivotally coupled with each other.

14. The frame of claim 13, wherein the first bar and the second bar are pivotally coupled with each other at their proximal ends by a pivoting mechanism, wherein the pivoting mechanism comprises:

a first coupling piece fixed at the proximal end of the first bar, wherein the first coupling piece comprises a first slot elongated in a first direction;

a second coupling piece fixed at the proximal end of the second bar, wherein the second coupling piece comprises a second slot, wherein the second slot has a closed bottom and an open top, and wherein the second slot has a length in the first direction that is shorter than the first slot of the first coupling piece in the first direction;

a third coupling piece comprising a third slot having a closed bottom and a closed top, wherein the third slot is elongated in the first direction;

a first rod disposed, cross-sectional-wise, in the third slot of the third coupling piece and movable along the third slot of the third coupling piece, wherein the first and second coupling pieces are pivotally coupled with each other by the first rod; and a second rod integrally formed or coupled with a top portion of the third coupling piece, the second rod disposed, cross-sectional-wise, in the first slot of the first coupling piece and movable along the first slot of the first coupling piece;

wherein when the first and second coupling pieces are aligned with each other and the open top of the second slot of the second coupling piece faces downwardly, the third coupling piece together with the second rod moves by gravity to a first position where the second rod is disposed outside of the second slot of the second coupling piece, thereby allowing the first and second coupling pieces to rotate with respect to each other around the first rod; and wherein when the first and second coupling pieces are aligned with each other and the open top of the second slot of the second coupling piece faces upwardly, the third coupling piece together with the second rod moves by gravity to a second position where the second rod is disposed in the second slot of the second coupling piece, thereby restricting the first and second coupling pieces from rotating with respect to each other around the first rod.

15. The frame of claim 14, wherein the first rod is disposed adjacent to the bottom of the third slot of the third coupling piece at the first position, and adjacent to the top of the third slot of the third coupling piece at the second position.

16. The frame of claim 14, wherein each of the first and second coupling pieces comprises a horizontal piece, a first lug at a first side of the horizontal piece and a second lug at a second side of the horizontal piece, wherein the first and second lugs are substantially parallel to each other; and each of the first and second lugs is formed with a corresponding first or second slot.

17. The frame of claim 16, wherein at least a portion of the third coupling piece is disposed between the first and second lugs of the first coupling piece, and at least a portion of the first and second lugs of the first coupling piece is disposed between the first and second lugs of the second coupling piece.

18. The frame of claim 14, wherein the first and second coupling pieces are pivotally coupled with each other by the first rod through a first hole formed at the first coupling piece and a second hole formed at the second coupling piece, and wherein the second rod is coupled with the third coupling piece by passing through a third hole formed at the third coupling piece.

19. The frame of claim 14, wherein when the first and second coupling pieces are aligned with each other, the first slot of the first coupling piece and the third slot of the third coupling piece are aligned with each other in the first direction.

20. The frame of claim 13, wherein for each of the first and second longitudinal bars, the frame further comprises:

a first coupler disposed adjacent to a distal end of the first bar; and a second coupler disposed adjacent to a distal end of the second bar;

wherein when the first and second bars are folded onto each other, the first and second couplers are engaged with each other, thereby preventing the first and second bars from accidental unfolding.

* * * * *